US008086128B2

(12) United States Patent
Takahashi

(10) Patent No.: US 8,086,128 B2
(45) Date of Patent: Dec. 27, 2011

(54) IMAGE FORMING APPARATUS WITH AN INTERMEDIATE TRANSFER MEMBER AND A PLURALITY OF CLEANING MEMBERS

(75) Inventor: Masaaki Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/892,529

(22) Filed: Sep. 28, 2010

(65) Prior Publication Data

US 2011/0013923 A1 Jan. 20, 2011

Related U.S. Application Data

(62) Division of application No. 12/049,556, filed on Mar. 17, 2008, now Pat. No. 7,826,764.

(30) Foreign Application Priority Data

Jun. 6, 2007 (JP) ..... 2007-149987

(51) Int. Cl.
*G03G 15/00* (2006.01)

(52) U.S. Cl. ..... 399/71; 399/101; 399/343

(58) Field of Classification Search ..... 399/71, 399/101, 343
See application file for complete search history.

(56) References Cited

U.S. PATENT DOCUMENTS

2008/0050140 A1 2/2008 Oku

FOREIGN PATENT DOCUMENTS

| | | | |
|---|---|---|---|
| JP | 2002278319 | A | 9/2002 |
| JP | 2005-99127 | A | 4/2005 |
| JP | 2007-121965 | A | 5/2007 |

OTHER PUBLICATIONS

Notification for Refusal dated May 17, 2011 issued by the Japanese Patent Office in counterpart application No. 2007-149987.
U.S. Appl. No. 12/049,556, filed Mar. 17, 2008.

*Primary Examiner* — David Gray
*Assistant Examiner* — Roy Y Yi
(74) *Attorney, Agent, or Firm* — Sughrue Mion, PLLC

(57) ABSTRACT

An image forming apparatus includes: an image forming device; an intermediate transfer member; a secondary transferring device; a first cleaning member; a second cleaning member; a contacting/separating device; a release-agent applying device; and a controlling unit.

5 Claims, 17 Drawing Sheets

IMAGE FORMING APPARATUS WITH AN INTERMEDIATE TRANSFER MEMBER AND A PLURALITY OF CLEANING MEMBERS

CROSS-REFERENCE TO RELATED APPLICATIONS

This is a division of application Ser. No. 12/049,556, filed Mar. 17, 2008. The entire disclosure of the prior application, application Ser. No. 12/049,556 is considered part of the disclosure of the present application and is hereby incorporated by reference. Further, this application is based on and claims priority under 35 USC 119 from Japanese Patent Application No. 2007-149987 filed on Jun. 6, 2007.

BACKGROUND

1. Technical Field

The present invention relates to an image forming apparatus having an intermediate transfer member.

2. Related Art

As an image forming apparatus such as a printer or a copier, there are apparatuses employing the so-called intermediate transfer system where, after a toner image developed by a toner serving as a developer is formed on an image forming member such as a photosensitive member, the toner image is once transferred to an intermediate transfer member which is rotated while contacting with the image forming member, and then the toner that has been transferred to and held by the intermediate transfer member is secondary-transferred to a sheet at a secondary transfer position.

In an image forming apparatus employing the intermediate transfer system, usually, a toner and the like remain on the surface of an intermediate transfer member after a process such as the secondary transfer. In order to remove the residual toner and the like, therefore, the apparatus is equipped with a cleaning device which causes an elastic blade such as a rubber plate to be in contact with the surface of the intermediate transfer member, thereby cleaning the surface.

When a toner to be used in the image formation is reduced in diameter and spheronized, however, a cleaning device hardly maintains the performance of cleaning an intermediate transfer member with respect to a toner of this kind.

SUMMARY

According to an aspect of the invention, there is provided an image forming apparatus having: an image forming device which forms an image developed by a toner, and which transfers the image; an intermediate transfer member which is rotated while holding the toner image transferred from the image forming device; a secondary transferring device which secondary-transfers the toner image held by the intermediate transfer member, to a sheet; a first cleaning member that cleans the surface of the intermediate transfer member which has been passed through the secondary transferring device, in a state where the first cleaning member is in contact with a surface of the intermediate transfer member; a second cleaning member that cleans the surface of the intermediate transfer member downstream of the first cleaning member in a rotation direction, in a state where the second cleaning member is in contact with a surface of the intermediate transfer member; a contacting/separating device that displaces the first cleaning member to a state where the first cleaning member is in contact with the surface of the intermediate transfer member, and a state where the first cleaning member is separated from the surface of the intermediate transfer member; a release-agent applying device that applies a release agent in a state where the contacting/separating device is in contact with a surface of the intermediate transfer member, the surface of the intermediate transfer member being downstream in the rotation direction from a position that the second cleaning member is in contact with the intermediate transfer member, and the surface of the intermediate transfer member being upstream in the rotation direction from a member that is first in contact with the surface of the intermediate transfer member on the downstream in the rotation direction from a position that the second cleaning member is in contact with the intermediate transfer member.

BRIEF DESCRIPTION OF THE DRAWINGS

Exemplary embodiments of the present invention will be described in detail based on the following figures, wherein.

DESCRIPTION OF REFERENCE NUMERALS AND SIGNS

1A, 1B, 1C, 1D . . . image forming apparatus, 6A, 6B . . . release agent, 8 . . . controlling device (controlling unit), 9 . . . sheet, 10 . . . image forming device, 12 . . . photosensitive drum (member which is first in contact), 21 . . . intermediate transfer belt (intermediate transfer member), 24 . . . support roll (part of secondary transferring device), 25 . . . secondary transfer roll (part of secondary transferring device), 30 . . . fixing device, 32 . . . heating roll (fixing member), 33 . . . pressurizing rotary member (fixing member), 42 . . . sheet conveying device, 48 . . . reversing and reconveying device, 51 . . . first cleaning plate (first cleaning member), 52 . . . second cleaning plate (second cleaning member), 55 . . . contacting/separating device, 60, 65 . . . release-agent applying device, 82 . . . counter (part of sheet number counting unit), S1 . . . sheet detection sensor (part of sheet number counting unit), B . . . rotation direction of intermediate transfer member.

DETAILED DESCRIPTION

First Embodiment

Figure 1:
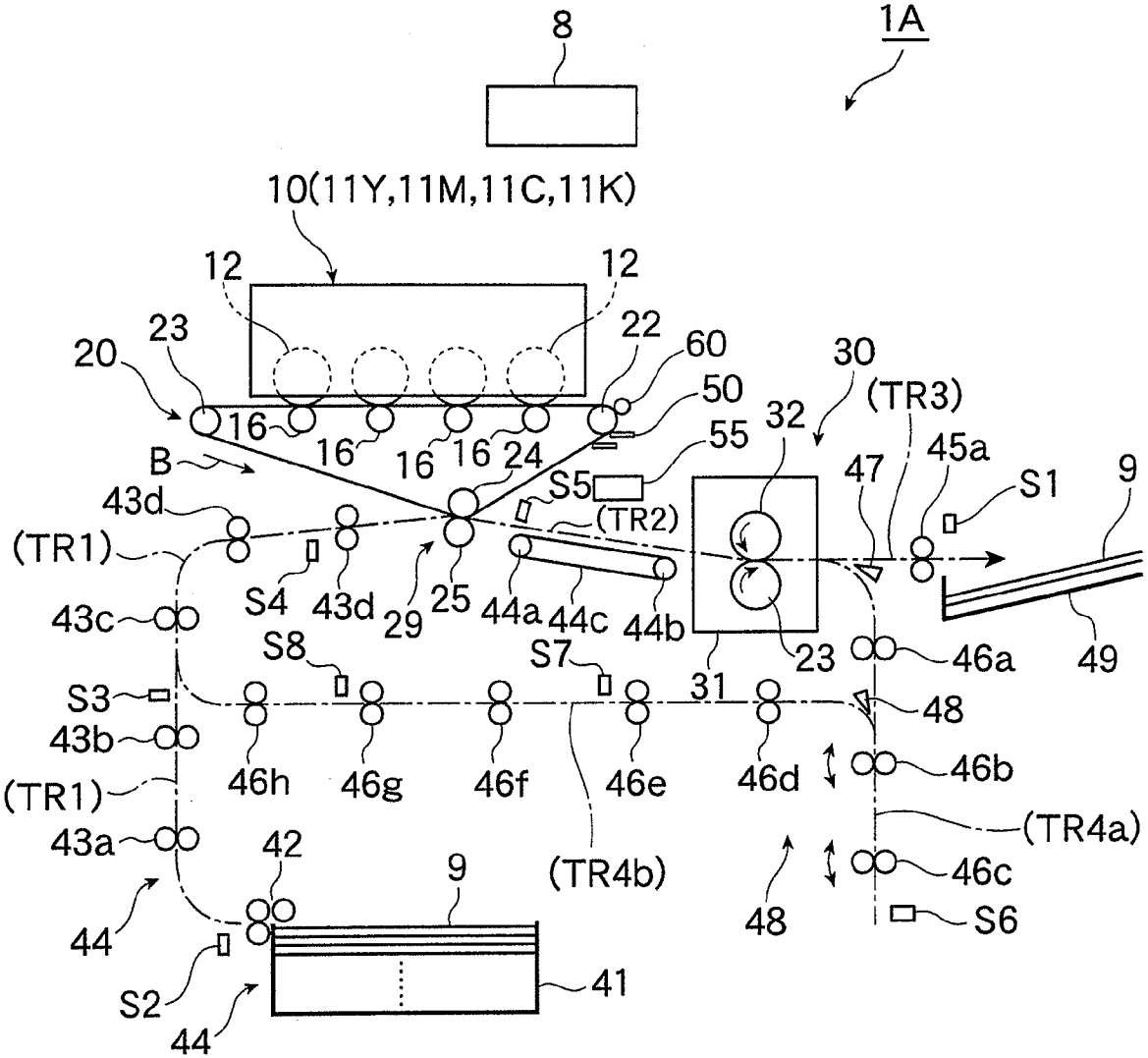
FIG. 1 is a diagram schematically showing an image forming apparatus of a first embodiment of the invention.

FIG. 1 schematically shows an image forming apparatus 1A of a first embodiment of the invention.

In the image forming apparatus 1A, as shown FIG. 1, an image forming device 10 which forms a toner image based on image information, and which transfers the image, an intermediate transferring device 20 which holds the toner image formed by the image forming device 10 to finally transfer the toner image to a sheet 9, a fixing device 30 through which the sheet 9 onto which the toner image is transferred by the intermediate transferring device 20 is passed to fix the toner image, and a sheet feeding device 40 which feeds the sheet 9 to a secondary transfer position of the intermediate transferring device 20 are mainly disposed in the body (not shown) of the apparatus. In the figure, the reference numeral 8 denotes a controlling device which generally controls operations and the like of components of the image forming apparatus LA as described later, and the arrowed one-dot chain line indicates a main conveying route (or conveying path) for the sheet 9.

Using one of the electrophotographic system, the electrostatic recording system, and the like which are known, the image forming device 10 can form a toner image developed by a toner serving as a developer, and transfer the toner image. In the embodiment, a color-image forming device which independently forms color toner images of yellow (Y), magenta (M), cyan (C), and black (K), and then transfers the toner images is used. Specifically, four image forming portions (11Y, 11M, 11C, 11K) which respectively specialize in formation and transfer of a toner image of the corresponding color are arranged in a series manner.

Figure 2:
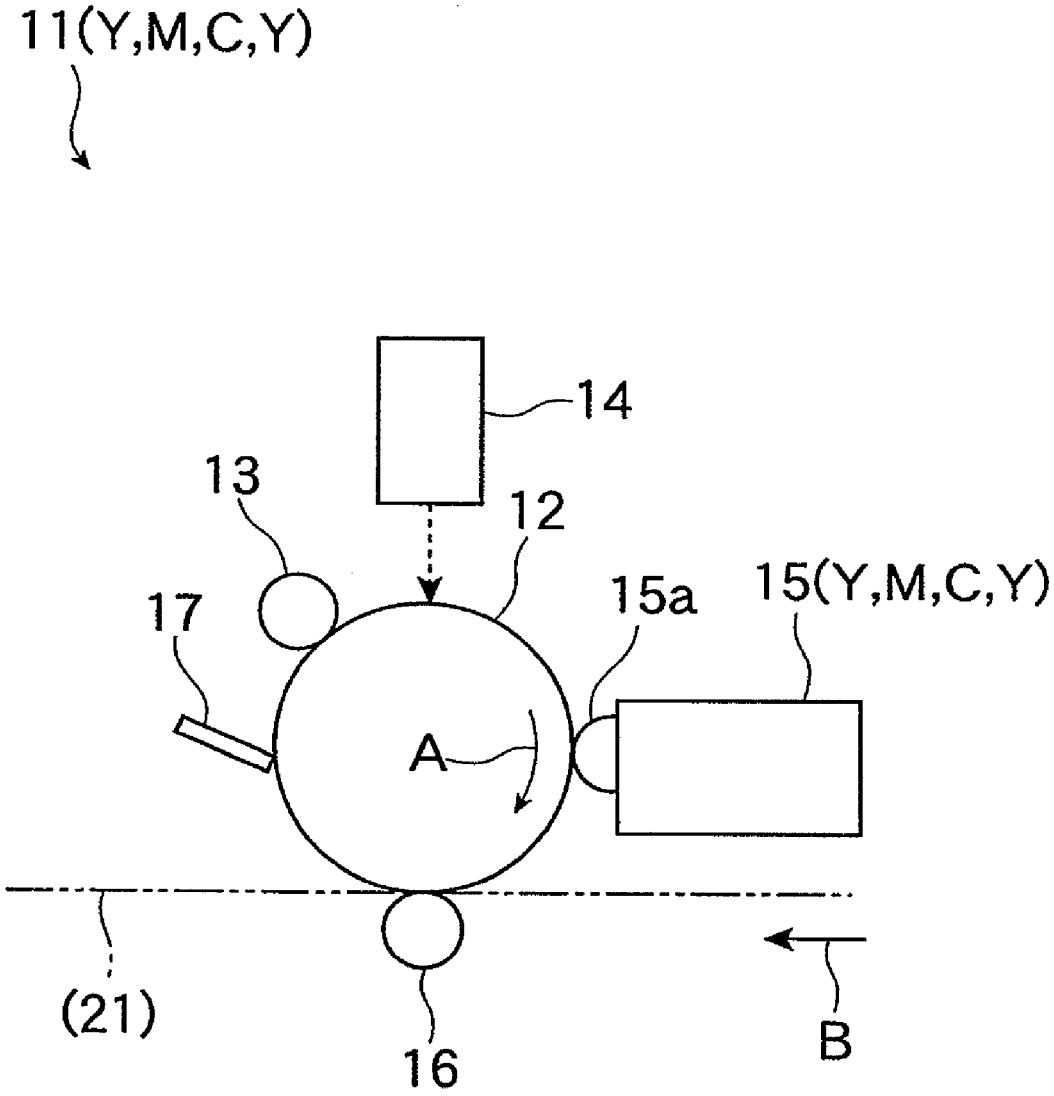
FIG. 2 is a diagram showing a partial configuration of an image forming device of the image forming apparatus of FIG. 1.

As shown in FIG. 2 and described later, the image forming portions (11Y, 11M, 11C, 11K) are configured in a substantially common manner. Each of the image forming portions basically comprises a photosensitive drum 12 which is rotated in the direction of the arrow A (a clockwise direction in the figure), and has a configuration where a charging device 13 having a charging roll or the like which uniformly charges the surface (image forming face) of the photosensitive drum 12, an exposing device 14 formed by an LED array, a laser scanning device, or the like which irradiates the charged surface of the photosensitive drum 12 with light based on image information (signal) to form an electrostatic latent image (of the corresponding color) having a potential difference, a developing device 15(Y, M, C, K) for performing a developing process in which the toner of the corresponding color (Y, M, C, K) is moved and adheres to the latent image, thereby forming a toner image, a primary transferring device 16 having a transfer roll or the like which transfers the toner image to (an intermediate transfer belt of) the intermediate transferring device 20, and a first cleaning device 17 which removes away a toner and the like remaining on the surface of the photosensitive drum 12 after the transfer process are mainly arranged around the photosensitive drum 12.

In the photosensitive drum 12, a photoconductive layer (photosensitive layer) made of an organic photosensitive material is formed on a cylindrical base member which is grounded. The exposing device 14 receives an image signal which is obtained by performing a required process in an image processing apparatus (not shown) on image information supplied from an apparatus disposed in or connected to the image forming apparatus 1A, such as a document reader, a recording medium reader, or a personal computer. During a period when an image is formed, a charging voltage, a developing voltage, and a primary-transferring voltage are applied at predetermined timings to the charging device 13, (a developing roll 15*a* of) the developing device 15, and the transferring device 16, from a power source device which is not shown, respectively.

The intermediate transferring device 20 is mainly configured by: the intermediate transfer belt 21 which is rotated in the direction of the arrow B (a counter clockwise direction in the figure) while being passed through gaps (primary transfer position) between the photosensitive drums 12 and the transferring devices 16 in the image forming device 10; plural support rolls 22 to 24 around which the intermediate transfer belt 21 is stretched in a desired state and rotatably supported; and a secondary transfer roll 25 which is rotated while contacting at a predetermined pressure with the intermediate transfer belt 21 supported by the support roll 24.

A belt that is formed as an endless belt having a predetermined thickness with using a material in which a predetermined amount of a resistance adjusting agent such as carbon is dispersed in a synthetic resin such as a polyimide resin, or a polyamide resin is used as the intermediate transfer belt 21. The support roll 22 is configured as a driving roll. At a predetermined timing, the power source device which is not shown applies a secondary-transferring voltage to the support roll 24 or the secondary transfer roll 25. In the intermediate transferring device 20, a position where the secondary transfer roll 25 is in contact with the intermediate transfer belt 21 is the secondary transfer position where the sheet 9 is introduced and passed therethrough and the toner image is transferred from the intermediate transfer belt 21 to the sheet 9, and a secondary transferring device 29 is configured by the secondary transfer roll 25, the support roll 24, the power source device, etc.

The fixing device 30 is configured by, in a case 31, disposing: a heating roll 32 which is rotated in the direction of the arrow, and which is heated by a heating unit so that the surface temperature is held to a predetermined temperature; and a pressurizing rotary member 33 which is in contacted with the heating roll 32 to be rotated, substantially along the axial direction of the roll and at a predetermined pressure, and which is in the form of a roll, a belt, or the like. The fixation by the fixing device 30 is performed by introducing the sheet 9 onto which the toner image has been transferred, into a contacting portion where the heating roll 32 which is rotated in a heated state is in contact with the pressurizing rotary member 33, and heating and pressurizing the sheet when the sheet is passed through the contacting portion.

The sheet feeding device 40 mainly comprises: a sheet feeding cassette 41 in which plural sheets 9 of the size and kind that can be used in the image formation by the image forming apparatus 1A are housed in a stacked manner corresponding to the feeding direction; and a feeding mechanism 42 which feeds one by one the sheets 9 housed in the sheet feeding cassette 41. As required, plural sheet feeding cassettes 41 are prepared.

A first sheet conveying path TR1 which conveys the sheet 9 fed from the sheet feeding device 40 to the secondary transfer position of the intermediate transferring device 20 is placed between the sheet feeding device 40 and the secondary transfer position. The first sheet conveying path TR1 is configured by a sheet conveying device 43 for sheet feeding which is formed by plural sheet conveying roll pairs 43*a*, 43*b*, 43*c*, . . . , guide members that are not shown, etc. A second sheet conveying path TR2 which conveys the sheet 9 that has been passed through the secondary transfer position to the fixing device is placed between the secondary transfer position of the intermediate transferring device 20 and the fixing device 30. The second sheet conveying path TR2 is configured by a belt conveying device 44 which is formed by a conveying belt 44*c* that is rotated while being supported by plural supporting rolls 44*a*, 44*b*. A discharging path TR3 which conveys the sheet 9 after the fixation to be discharged to a discharging and housing portion 49 for the sheet 9 is placed between the fixing device 30 and the discharging and housing portion 49. The discharging path TR3 is configured by a sheet conveying device 45 for sheet discharging which is formed by a sheet conveying roll pair 45*a*, guide members (not shown), etc.

A fourth sheet conveying path TR4 which reverses the sheet 9 that has been passed through the fixing device 30, and which then reconveys the sheet to the secondary transfer position is placed between a part of the discharging path TR3 and that of the first sheet conveying path TR1. The fourth sheet conveying path TR4 is configured by a reversing and reconveying device 48 which is formed by plural sheet conveying roll pairs 46*a*, 46*b*, 46*c*, . . . , guide members (not shown), conveyance destination changing guides 46, 47 which guide and change the conveyance destination (conveying path) of the sheet 9, etc. The fourth sheet conveying path TR4 is configured by: a pull conveying path TR4*a* which once pullingly conveys the sheet 9 that has been passed through the fixing device 30, in accordance with the guidance of the conveyance destination changing guide 46; and a reversing and reconveying path TR4*b* which feeds the sheet 9 that has been pulled into the pull conveying path TR4*a*, in a manner like the switch-back system in accordance with the guidance of the conveyance destination changing guide 47 to convey the sheet until it enters the first sheet conveying path TR1. As the sheet conveying roll pairs 46*b*, 46*c* disposed in the pull conveying path TR4*a*, rollers which can be switchingly rotated in the both (forward and reverse) directions are used. The fourth sheet conveying path TR4 is used in the double-face image formation in which images are formed on the front and rear faces of the sheet 9, and may be omitted in the case where the operation of the double-face image formation is not necessary.

In the image forming apparatus 1A, a second cleaning device 50 in which a toner and the like remaining on the surface of the intermediate transfer belt 21 of the intermediate transferring device 20 after the secondary transfer are removed away by two cleaning plates 51, 52 that are in contact with the belt surface (the outer peripheral face serving as a toner image holding face), and a first release-agent applying device 60 which applies a release agent to the surface of the intermediate transfer belt 21 are disposed. Moreover, the apparatus is set so that, under the control of the controlling device 8, an operation of causing the first cleaning plate 51 of the second cleaning device 50 to be in a state where it is separated from the surface of the intermediate transfer belt 21 is performed at a predetermined timing.

Figure 3:
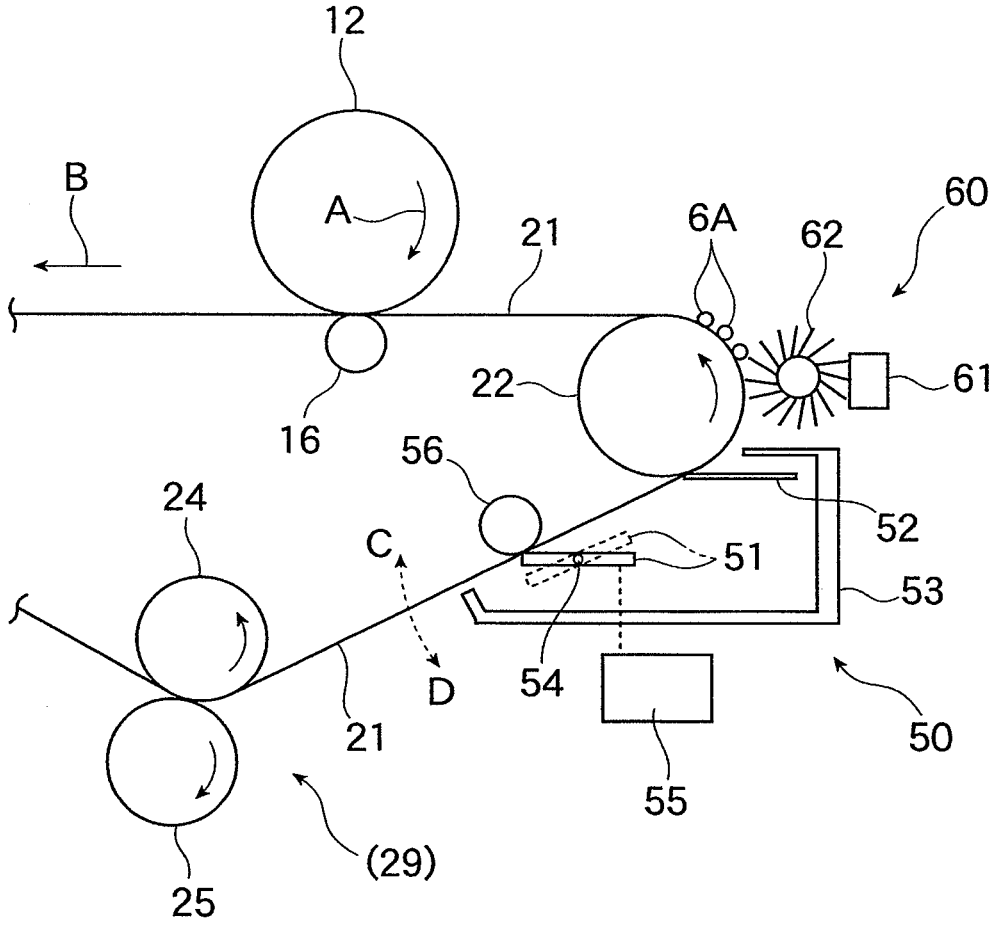
FIG. 3 is a diagram showing configurations of a release-agent applying device and a cleaning device of the image forming apparatus of FIG. 1.

As shown in FIG. 3 and the like, the second cleaning device 50 comprises the first and second cleaning plates 51, 52 which are contacted with the surface of the intermediate transfer belt 21 sequentially from the upstream side in the rotation direction (direction of the arrow B) of the belt while forming a gap therebetween. In the cleaning device 50, in order to accommodate a toner and the like which have been scraped off by the two cleaning plates 51, 52, the cleaning plates 51, 52 are disposed in a state where they are in the internal space of a case 53 having a form in which at least a portion opposed to the surface of the intermediate transfer belt 21 is opened.

By using a rubber material such as urethane rubber, the first cleaning plate 51 is formed into a plate-like form having a length which allows the member to be in contact with a substantially whole range (including at least a toner image holding region) of the intermediate transfer belt 21 in the width direction (direction substantially perpendicular to the rotation direction). By using a metal material such as stainless steel, the second cleaning plate 52 is formed into a plate-like form having a length which is approximately equal to that of the first cleaning plate 51.

The first cleaning plate 51 is attached so as to be swingable in the directions of the arrows C, D while a predetermined portion is supported by a support shaft 54, whereby a contacting end portion 51*a* which is contactable with the surface of the intermediate transfer belt 21 is displaced to either of a state where it is contacted with the belt surface, and that where it is separated from the belt surface. The first cleaning plate 51 is caused to swing in the directions of the arrows C, D by a power of a contacting/separating device 55. As the contacting/separating device 55, any device can be used as far as it can cause the first cleaning plate 51 to swing in the directions of the arrows C, D. For example, a device employing adequate means such as a gear mechanism, a cam mechanism, or a solenoid mechanism may be used. The operation of the contacting/separating device 55 is controlled by the controlling device 8 as described later. Usually, the first cleaning plate 51 is kept to the state where it is in contact with the surface of the intermediate transfer belt 21.

By contrast, the second cleaning plate 52 is attached in a state where, in order to allow one end portion to be always kept to be in contact with the surface of the intermediate transfer belt 21, the other end portion is fixedly held. In the second cleaning plate 52, as a position which is in contact with the surface of the intermediate transfer belt 21, usually, a portion in which the intermediate transfer belt 21 begins to be supported by the support roll 24, or that which is in the supported region is employed. Alternatively, a belt portion in a free state where it is not supported by the support roll 24 may be employed. In the embodiment, by contrast, the first cleaning plate 51 is in contact with a portion of the intermediate transfer belt 21 where it is not supported by the support roll 24. Therefore, a support member 56 such as a roll is disposed for supporting the portion of the intermediate transfer belt 21 with which the first cleaning plate 51 is in contact, from the inner peripheral side of the belt. The angles at which the two cleaning plates 51, 52 are contacted with the intermediate transfer belt 21 can be adequately set. Preferably, the angles (smaller angles) with respect to the belt surface may be set so as to have a value in the range of, for example, 15° to 30°. The distance between positions where the two cleaning plates 51, 52 are contacted with the intermediate transfer belt 21 can be adequately set. From the viewpoint that their cleaning performances are satisfactorily exerted, for example, the distance may be adequately set.

The release-agent applying device 60 is mainly configured by a solid-type release agent 61, and a rotary application brush 62 which is rotated while being contacted with the solid-type release agent 61 and the surface of the intermediate transfer belt 21. As the release agent 61, preferably, an agent which does not exert an adverse effect on transfer and holding of a toner image, and which can provide a toner and the like on the surface of the intermediate transfer belt 21 with high release characteristics. For example, an agent essentially containing zinc stearate and the like may be used. The rotary application brush 62 is placed so as to be contacted with the portion (in the region) of the intermediate transfer belt 21 which is supported by the support roll 24. Namely, the rotary application brush 62 is placed at a position where it is contacted in advance of the photosensitive drum 12 of the image forming device 10 which is first in contact with the surface portion of the intermediate transfer belt 21 that has been passed through the second cleaning device 50. The rotary application brush 62 (the release-agent applying device 60) is configured so that it is always in contact with the intermediate transfer belt 21 to apply the release agent thereto. Alternatively, the brush may be configured so that, only when needed, it is in contact with the intermediate transfer belt 21 to perform the application of the release agent, and, in the other period, separated from the belt 21.

Figure 4:
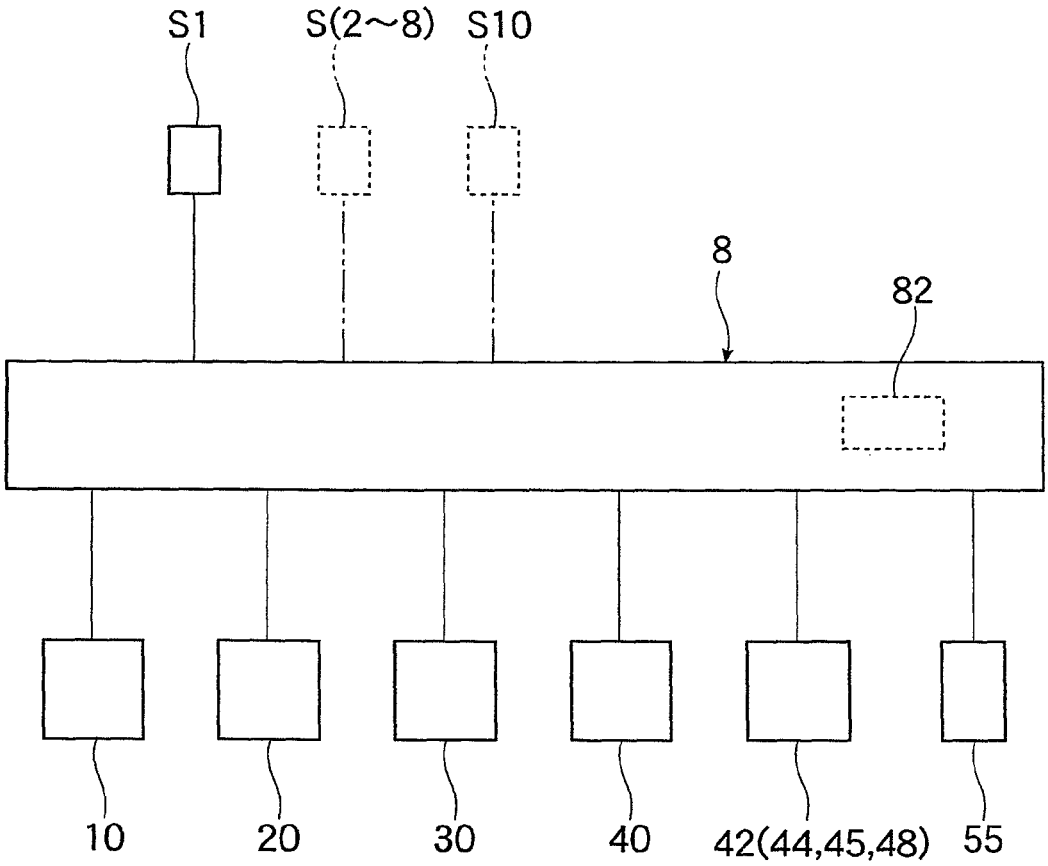
FIG. 4 is a block diagram showing configurations of a controlling device and its control system.

In the image forming apparatus 1A, as shown in FIG. 4, the controlling device 8 configured by an arithmetic processing unit, a storage device, input/output devices, and the like is connected so as to generally control the operations of the above-described components, and the like including the image forming device 10, the intermediate transferring device 20, the fixing device 30, the sheet feeding device 40, and the sheet conveying device (including the conveying devices 44, 45 and the reversing and reconveying device 48), and further connected so as to control also the contacting/separating device 55 in the second cleaning device 50.

Figure 5:
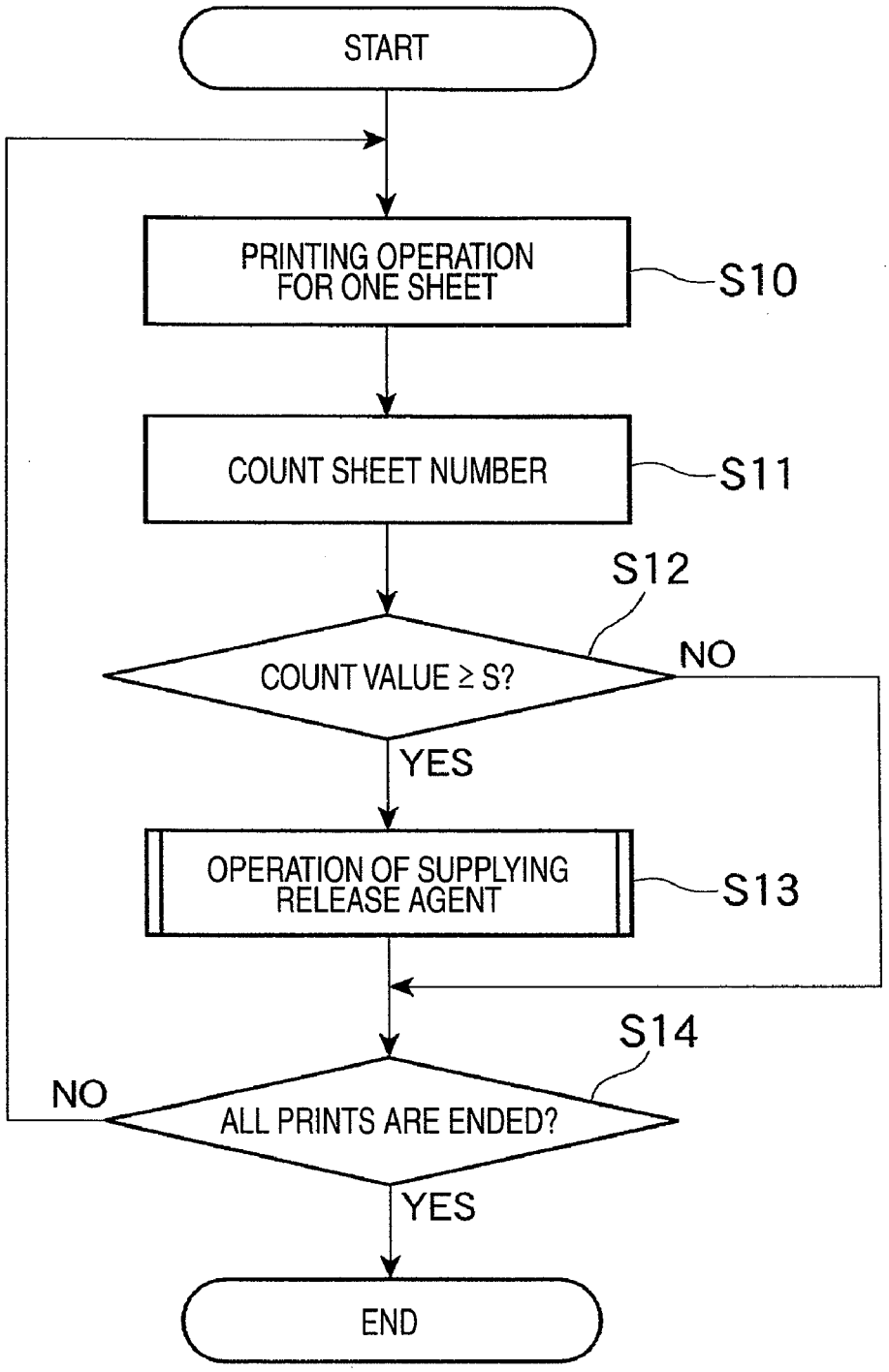
FIG. 5 is a flowchart showing an operation relating to a timing when an operation of supplying a release agent is performed in the first embodiment.

As shown in FIG. 5, particularly, the control of the operation of the contacting/separating device 55 by the controlling device 8 is performed so that, at a preset timing, the above-described first cleaning plate 51 is displaced to the state where it is separated from the surface of the intermediate transfer belt 21. This allows the below-described operation of supplying the release agent to the second cleaning plate 52 to be performed. Specifically, at the timing, the contacting/separating device 55 is driven so that the first cleaning plate 51 in the state where it is in contact with the surface of the intermediate transfer belt 21 is caused to swing in the direction of the arrow D.

In the embodiment, the above-mentioned predetermined timing is set to a timing when the number of sheets 9 on which the image formation has been normally performed by the image forming apparatus 1A reaches a specified number (S). The number is counted in the following manner. As shown in FIGS. 1 and 4, the controlling device 8 is provided with a counter (function) 82 which is operated by software, a sheet discharge detection sensor S1 which detects that the sheet 9 on which the image formation has been performed is completely passed through the sheet conveying roll pair 45*a* of the discharging path TR3 is disposed, and the counter 82 cumulatively counts the number of receptions of a detection signal obtained from the sheet discharge detection sensor S1.

Next, operations in the image forming apparatus 1A will be described.

First, a basic image forming operation in the case where a full-color image is to be formed on one face of the sheet 9 will be described (hereinafter, such an operation is often referred to as "printing operation").

When (the controlling device 8 of) the image forming apparatus 1A receives instructions for starting the printing operation, components such as the image forming device 10, the intermediate transferring device 20, the fixing device 30, the sheet feeding device 40, and the sheet conveying devices 42, 44, 45, 48 are operated in the following manner under the control of the controlling device 8. First, the photosensitive drums 12 of the image forming portions 11(Y, M, C, K) of the image forming device 10, and the intermediate transfer belt 21 of the intermediate transferring device 20 begin to be rotated, and the charging devices 13 charge the surfaces of the photosensitive drum 12 to a predetermined polarity and voltage. Then, the exposing devices 14 perform an exposure based on an image signal, on the charged photosensitive drums 12 to form an electrostatic latent image configured a predetermined potential difference. Thereafter, the developing devices 15 supply a toner charged to a predetermined polarity from the developing rolls 15*a* to develop the electrostatic latent image, whereby visible images are formed as toner images. As a result, toner images of the colors (Y, M, C, K) are formed on the photosensitive drums 12 of the image forming portions 11(Y, M, C, K), respectively.

When the toner images on the photosensitive drums 12 of the image forming portions 11(Y, M, C, K) arrive the respective primary transfer positions opposed to the transferring devices 16 and the intermediate transfer belt 21, the transferring devices 16 sequentially primary-transfer the toner images on the photosensitive drums 12 onto the intermediate transfer belt 21 by an electrostatic function. After the primary transfer, the surfaces of the photosensitive drums 12 are cleaned by the first cleaning devices 17, respectively. When the toner images which have been superimposedly transferred to the intermediate transfer belt 21 reach the secondary transfer position opposed to the secondary transfer roll 25, the sheet feeding device 40 and the sheet conveying device 42 of the first sheet conveying path TR1 are operated in synchronization with the timing of the arrival of the toner images, so that the secondary transfer roll 25 and the like secondary-transfer the toner images on the intermediate transfer belt 21 by an electrostatic function onto the sheet 9 conveyed to the secondary transfer position.

Then, the belt conveying device 44 of the second sheet conveying path TR2 is operated so as to convey the sheet 9 onto which the toner images have been secondary-transferred, and then introduce it into the fixing device 30. In the fixing device 30, when the sheet 9 onto which the toner images have been transferred is passed through the contacting portion between the heating roll 32 and the pressurizing rotary member 33, the toner of the toner images is fused and fixed to the sheet 9 by heating and pressurizing the sheet. In the case where the image formation is performed only on one face of the sheet 9, after the fixation is ended, the sheet conveying device 45 of the discharging path TR3 is operated so that the sheet is discharged to the discharging portion 49 to be stacked and housed therein. As a result, the basic printing operation on one sheet is ended. In the case where instructions for printing plural sheets are given, the series of operations which have been described above is similarly repeated plural times corresponding to the number of sheets.

In the case where the image formation is performed on the front and rear faces of the sheet 9 (double-face print), the following operations are added to the above-described printing operation for one face of the sheet 9.

First, after the printing operation of the first face of the sheet 9 is ended (specifically, after the sheet has been passed through the fixing device 30 and the fixation is ended), the reversing and reconveying device 48 of the fourth sheet conveying path TR4 is operated to convey the sheet 9 which has been passed through the fixing device 30 so as to be once pulled in the pull conveying path TR4*a* by the guiding function of the conveyance destination changing guide 46. Then, the pulled-in sheet 9 is sent toward the reversing and reconveying path TR4*b* by a reverse rotation of the sheet conveying roll pairs 46*b*, 46*c* and the guiding function of the conveyance destination changing guide 47, and thereafter the sheet is conveyed so as to enter the first sheet conveying path TR1 through the reversing and reconveying path TR4*b*.

Thereafter, when the sheet 9 is conveyed to the secondary transfer position through the first sheet conveying path TR1, toner images for the second face which have been formed and transferred in the image forming device 10 and the intermediate transferring device 20 are secondary-transferred onto the second face of the sheet 9 by the electrostatic function of the secondary transfer roll 25 and the like. In the same manner as the printing operation on the first face, the sheet in which the toner images have been transferred onto the second face undergoes the fixing process by the fixing device 30, and then is discharged to the discharging portion 49 through the discharging path TR3. As a result, the printing operation on the second face of the sheet 9 is ended, and images are formed on the both faces of the sheet 9, respectively.

During the printing operation (including the single-face image formation and the double-face image formation), the intermediate transfer belt 21 continues to be rotated, and hence the release agent is applied to the surface of the intermediate transfer belt 21 by the release-agent applying device 60 (FIG. 3). Specifically, the release agent 6A in the form of fine particles which is scraped off by the rotary application brush 62 from the solid-type release agent 61 of the release-agent applying device 60 is applied to the surface of the intermediate transfer belt 21 through the brush 62. Therefore, the release characteristics of the surface of the intermediate transfer belt 21 with respect to the toner are maintained in good condition. By the rotation of the intermediate transfer belt 21, the release agent 6A applied by the release-agent applying device 60 is transported so that part of the release agent is moved and adheres also to the photosensitive drums 12 of the image forming device 10, and secondary transfer roll 25 which are other components contacting with the surface of the intermediate transfer belt 21 before reaching the second cleaning device 50, but an adequate amount of the release agent remains and reaches the cleaning device 50 which is placed behind a position passing through it.

During the printing operation, even when a toner such as post-transfer toner or paper dust exists on the surface portion of the intermediate transfer belt 21 in which the secondary transfer has been ended, and which has been passed through the secondary transfer position, the remaining toner and the like are removed by the second cleaning device 50. Specifically, a toner and the like remaining on the surface portion of the intermediate transfer belt 21 after the secondary transfer are first scraped off and removed away by the first cleaning plate 51 which is first contacted with the surface portion at the position that is upstream in the rotation direction of the intermediate transfer belt 21. A toner and the like which are not removed by the first cleaning plate 51 are scraped off and removed away by the second cleaning plate 52 which is contacted with the surface portion at the position downstream of the first cleaning plate 51 in the rotation direction of the intermediate transfer belt 21.

In the second cleaning device 50, a toner and the like on the surface of the intermediate transfer belt 21 are sufficiently removed by the two cleaning plates 51, 52. Therefore, a phenomenon that such a toner and the like adhere to and contaminate the rotary application brush 62 of the release-agent applying device 60 which is in contact with the surface of the intermediate transfer belt 21 at the position downstream of the second cleaning device 50 in the rotation direction of the belt hardly occurs. The second cleaning device 50 can sufficiently remove a toner from the surface of the intermediate transfer belt 21 after the secondary transfer, even in the case where the toner is a small-diameter toner having a mean particle diameter of 6 pm or less, and spheronized so that the shape factor (SF-1: a value which is obtained by dividing the square of the maximum length (ML) of a shape formed by projecting the toner to a two-dimensional surface, by a figure area (A), and multiplying the quotient by $100\pi/4$) is 130 or less.

In the second cleaning device 50, the release agent 6A existing on the intermediate transfer belt 21 which has been passed through the secondary transfer position is captured in a state where the release agent is substantially blocked between the first cleaning plate 51 and the intermediate transfer belt 21 by the first cleaning plate. Because of the existence of the release agent 6A, the frictional resistance of the contacting portion of the first cleaning plate 51 to the surface of the intermediate transfer belt is kept to a reduced state. By contrast, most of the release agent 6A is captured by the first cleaning plate 51, and hence the release agent is hardly conveyed and supplied between the second cleaning plate 52 and the surface of the intermediate transfer belt 21.

Next, the operation performed when the cumulative count number of the sheets 9 in the case where the image formation is normally ended reaches a predetermined number S will be described.

As shown in FIG. 5, when the above-described printing operation for one sheet 9 is ended (step 10: S10), the sheet discharge detection sensor S1 detects the discharging of the sheet 9 to the discharging portion 49, thereby incrementing the sheet number of the counter 82 (S11). The controlling device 8 determines whether the count value of the counter 82 is equal to or more than the predetermined number S or not (S12). If the count value of the counter 82 does not reach the predetermined number S, it is checked whether the printing (all printing) operation on sheets the number of which is equal to that requested in the printing operation is ended or not (S14). If not ended, the printing operation for the remaining sheet number is continued, and, if ended, the requested printing operation is completely ended.

By contrast, if the count value of the counter 82 reaches the predetermined number S, the following operation of supplying the release agent is performed (S13).

Figure 6:
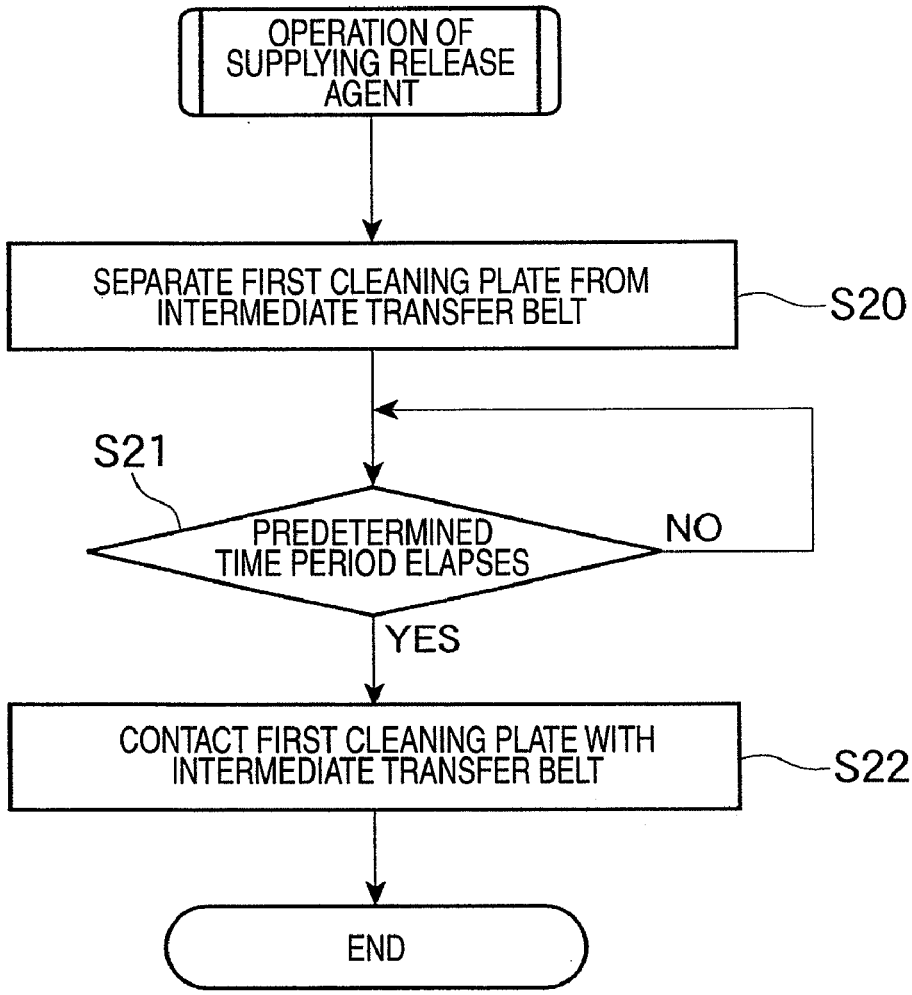
FIG. 6 is a flowchart showing the operation of supplying the release agent in the first embodiment.
Figure 7:
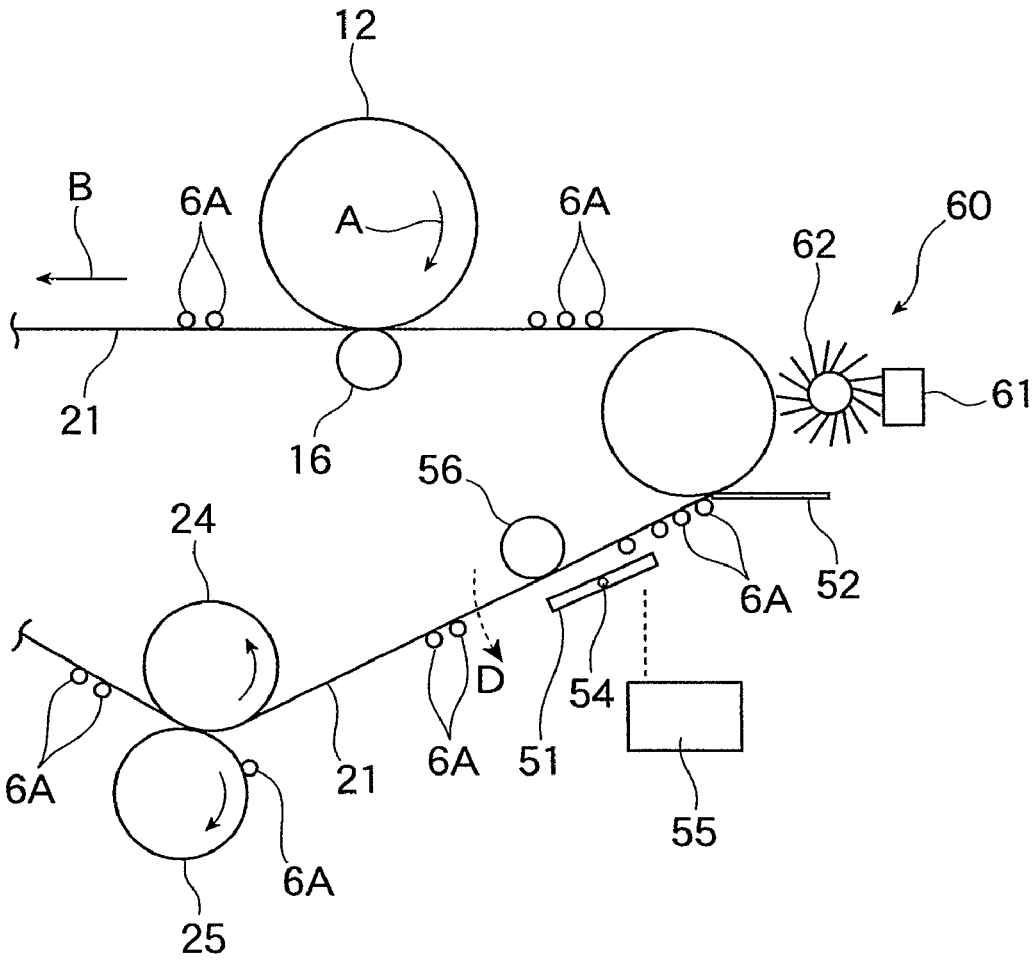
FIG. 7 is a diagram showing a state where the operation of supplying the release agent in the first embodiment is performed.

As shown in FIGS. 6 and 7, under the control of the controlling device 8, the contacting/separating device 55 is operated so that the first cleaning plate 51 of the second cleaning device 50 is swung in the direction of the arrow D about the support shaft 54, thereby forming a state where the contacting end portion of the first cleaning plate 51 is separated from the surface of the intermediate transfer belt 21 (see the operation of S20 in FIG. 6). Therefore, the release agent 6A which is applied to the surface of the intermediate transfer belt 21 is not scraped off by the first cleaning plate 51 from the surface of the intermediate transfer belt 21, and hence conveyed and supplied to the contacting portion between the second cleaning plate 52 and the surface of the intermediate transfer belt 21. As a result, even when a metal plate is used as the second cleaning plate 52, the frictional resistance of the cleaning plate 52 to the intermediate transfer belt 21 is reduced by the existence of the release agent 6A. Therefore, the phenomenon that streaky scratches are formed on the surface of the intermediate transfer member 21 by the contact of the cleaning plate 52 is reduced, and finally an image in which occurrence of image defects such as white streaks due to such streaky scratches is suppressed is formed.

The operation of supplying the release agent (the operation in which the first cleaning plate 51 is held to the state where it is separated from the surface of the intermediate transfer belt 21, and the release agent is conveyed to the second cleaning plate 52) is performed only during a period when a predetermined time period elapses after the timing when it is proved that the count value of the number of sheets on which an image is formed reaches the predetermined number S (see the operation indicated by S21 in FIG. 6). As the predetermined time period, a preset constant time period may be used, or, assuming that the printing operation to be performed remains, a time period extending to a timing immediately before the secondary transfer in the next one of the remaining printing operations is performed may be used. After the predetermined time period elapses, under the control of the controlling device 8, the contacting/separating device 55 is again operated so that the first cleaning plate 51 is swung in the direction of the arrow C about the support shaft 54, thereby forming a state where the contacting end portion of the first cleaning plate 51 is in contact with the surface of the intermediate transfer belt 21 (see the state of the cleaning plate 51 indicated by the solid line in FIG. 3, and the operation indicated by S22 in FIG. 6).

Second Embodiment

Figure 8:
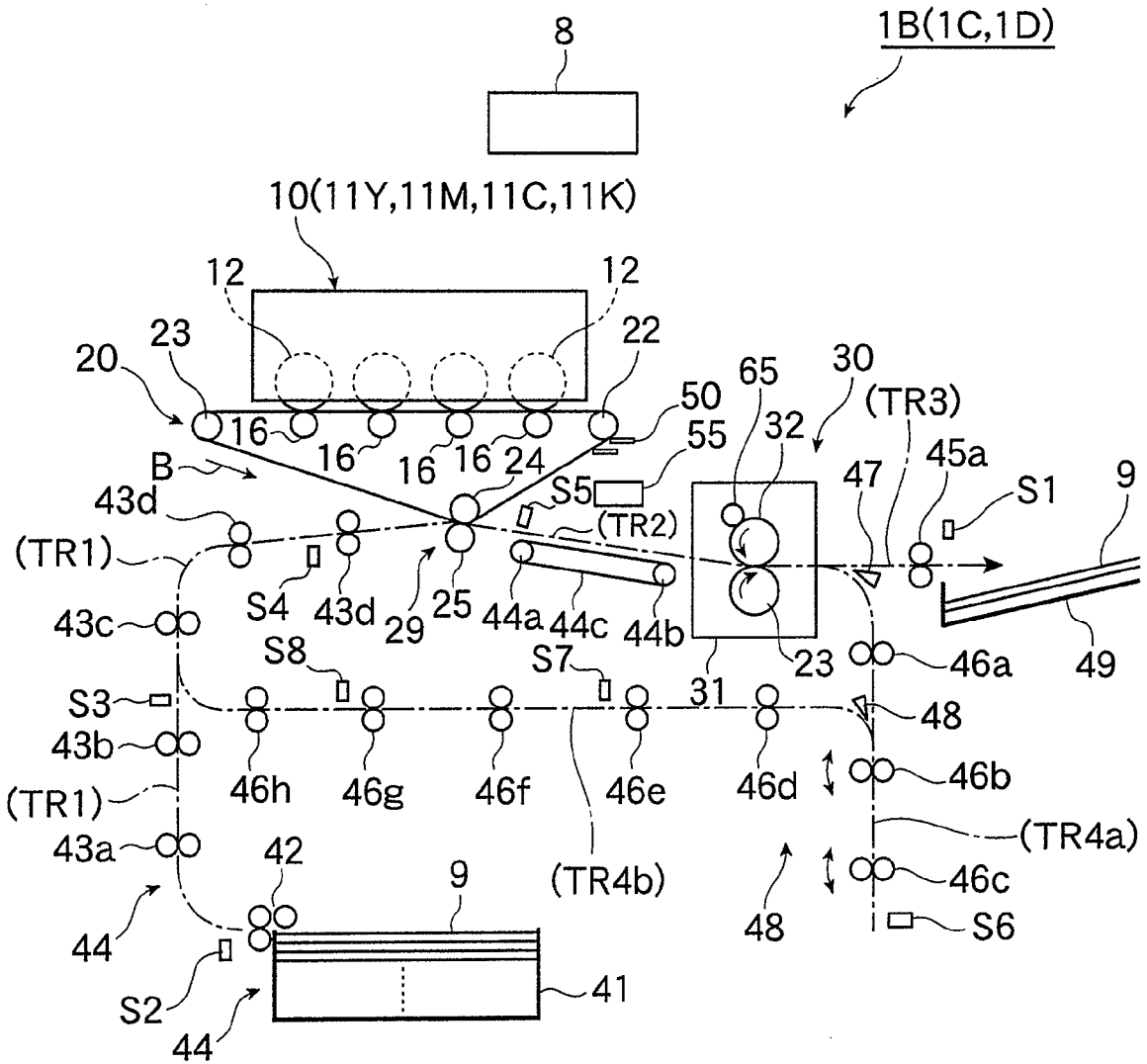
FIG. 8 is a diagram schematically showing an image forming apparatus of a second (third and fourth) embodiment of the invention.

FIG. 8 schematically shows an image forming apparatus 1B of a second embodiment of the invention.

The image forming apparatus 1B is configured in the same manner as the image forming apparatus 1A of the first embodiment except that a release-agent applying device 65 is disposed in the fixing device 30 in place of the disposition of the release-agent applying device 60 in the intermediate transferring device 20, and the configuration relating to the operation of supplying the release agent is changed.

Figure 9:
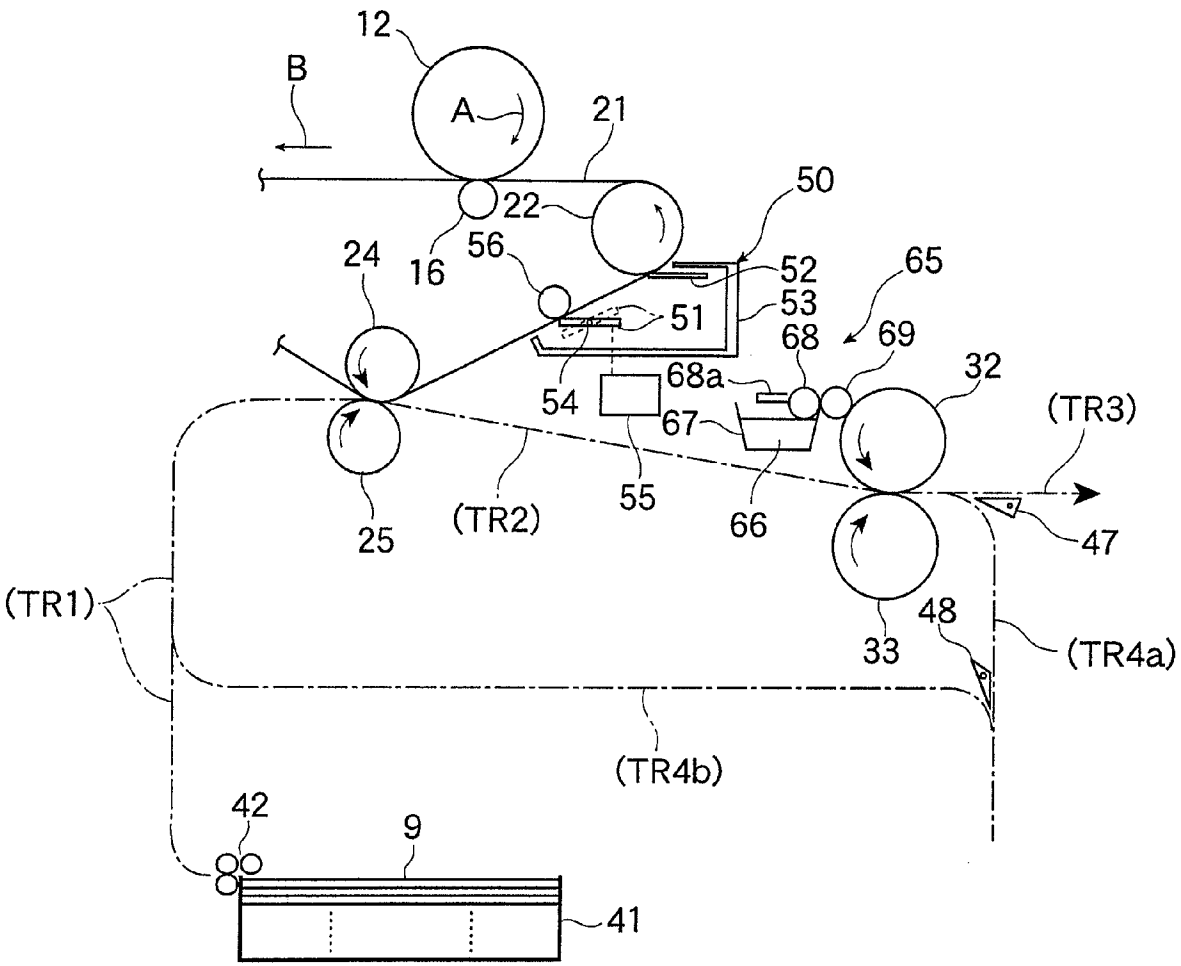
FIG. 9 is a diagram showing configurations of a release-agent applying device and a cleaning device of the image forming apparatus of FIG. 8.

As shown in FIG. 9, the release-agent applying device 65 is disposed on the side of the heating roll 32, and mainly configured by: a container 67 which stores a liquid release agent 66; a take-out roll 68 which is disposed so as to be rotated in a state where it is contacted with the release agent 66, and which causes the release agent 66 to adhere to the surface of the roll, thereby taking out the release agent; and a release-agent applying roll 69 which is rotated while contacting with both the take-out roll 68 and the heating roll 32. The liquid release agent 66 is used for providing the surfaces of the heating roll 32 and the pressurizing rotary member 33 with high release characteristics. Specifically, silicone oil or the like is used as the liquid release agent.

In the figure, the reference numeral 68*a* denotes a scraping plate which is disposed in a state where it is contacted with the take-out roll 68, and which scrapes off part of the release agent 66 adhering to the surface of the roll to regulate the amount of the toner to a predetermined amount.

Figure 10:
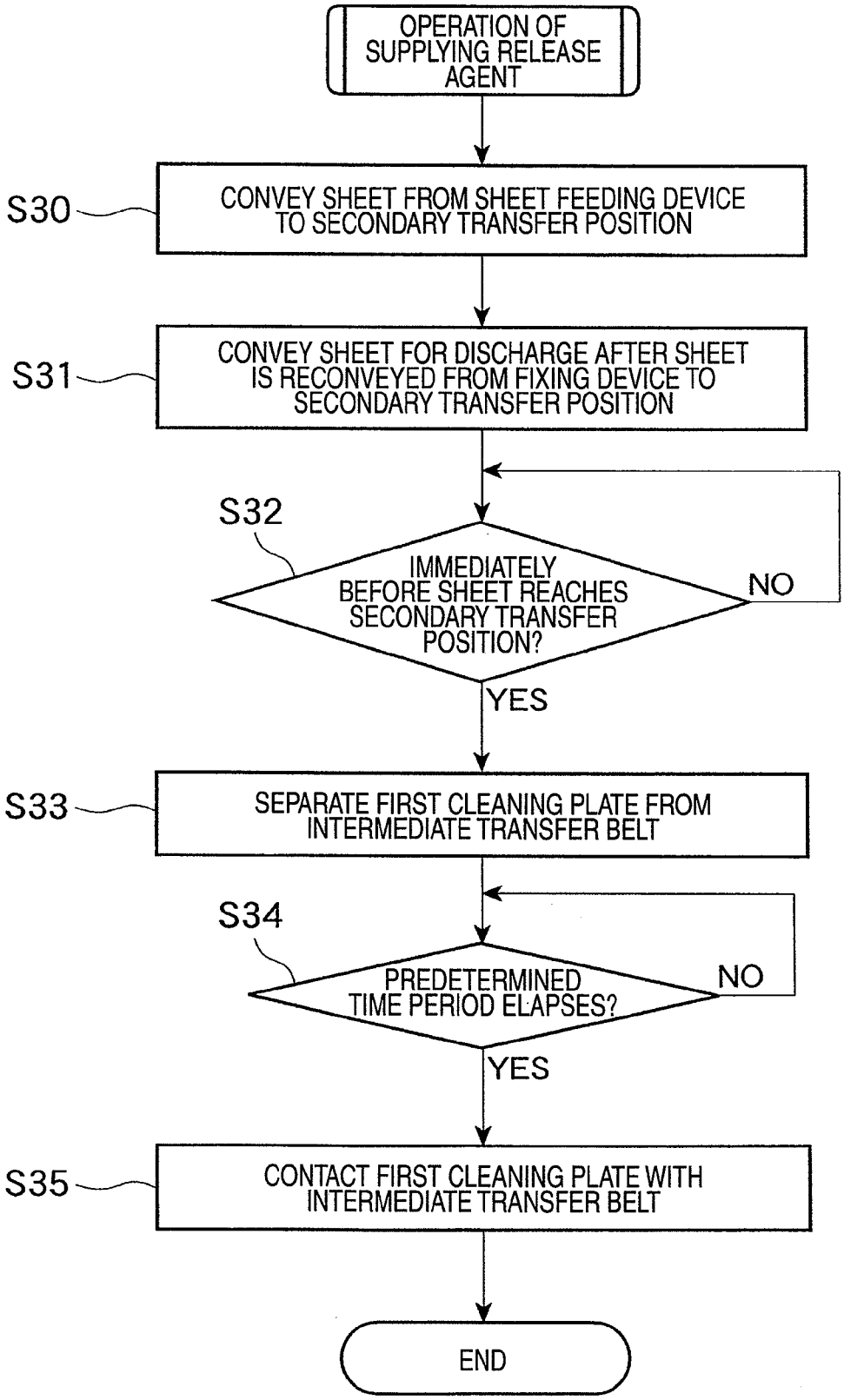
FIG. 10 is a flowchart showing the operation of supplying the release agent in the second embodiment.

As shown in FIG. 10 and the like, the operation of supplying the release agent is set in the following manner.

Under control of the controlling device 8, at a predetermined timing, an operation of, after the sheet 9 is conveyed from the sheet feeding device 40 to the secondary transfer position in the intermediate transferring device 20, passing the sheet through the fixing device 30, and then reconveying to the secondary transfer position is performed. Also an operation of, after a timing immediately before the sheet 9 is reconveyed to and reaches the secondary transfer position, setting the first cleaning plate 51 of the second cleaning device 50 to a state where it is separated from the surface of the intermediate transfer belt 21 is performed.

In the same manner as the first embodiment, the above-mentioned predetermined timing is set to a timing when the cumulative number of sheets 9 on which the image formation has been performed reaches the predetermined number S. The timing immediately before the sheet 9 is reconveyed to and reaches the secondary transfer position is set to a timing when a sheet detection sensor S4 (see FIG. 8) disposed at the nearest position on the front side of the secondary transfer position in the first sheet conveying path TR1 detects that the sheet 9 arrives.

Hereinafter, among operations of the image forming apparatus 1B, only those which are different from the operations of the image forming apparatus 1A of the first embodiment will be described.

In the operation of applying the release agent by the release-agent applying device 65, when the fixing device 30 is operated during the printing process, the heating roll 32 and the pressurizing rotary member 33 continue to be rotated, and hence the liquid release agent 66 stored in the container 67 of the release-agent applying device 65 is applied to the surface of the heating roll 32 via the take-out roll 68 and the release-agent applying roll. Part of the release agent 6B applied to the surface of the heating roll 32 is moved and adheres to the pressurizing rotary member 33 which is rotated in a state where it is in contact with the heating roll 32. Therefore, the release characteristics of the surfaces of the heating roll 32 and the pressurizing rotary member 33 continue with respect to the toner are maintained in good condition.

Next, the image forming apparatus 1B performs the image formation. When the cumulative number of sheets 9 on which the image formation has been normally performed reaches a specified number S, the operation of supplying the release agent is performed in the following manner (see the operation contents shown in FIG. 5).

Figure 11:
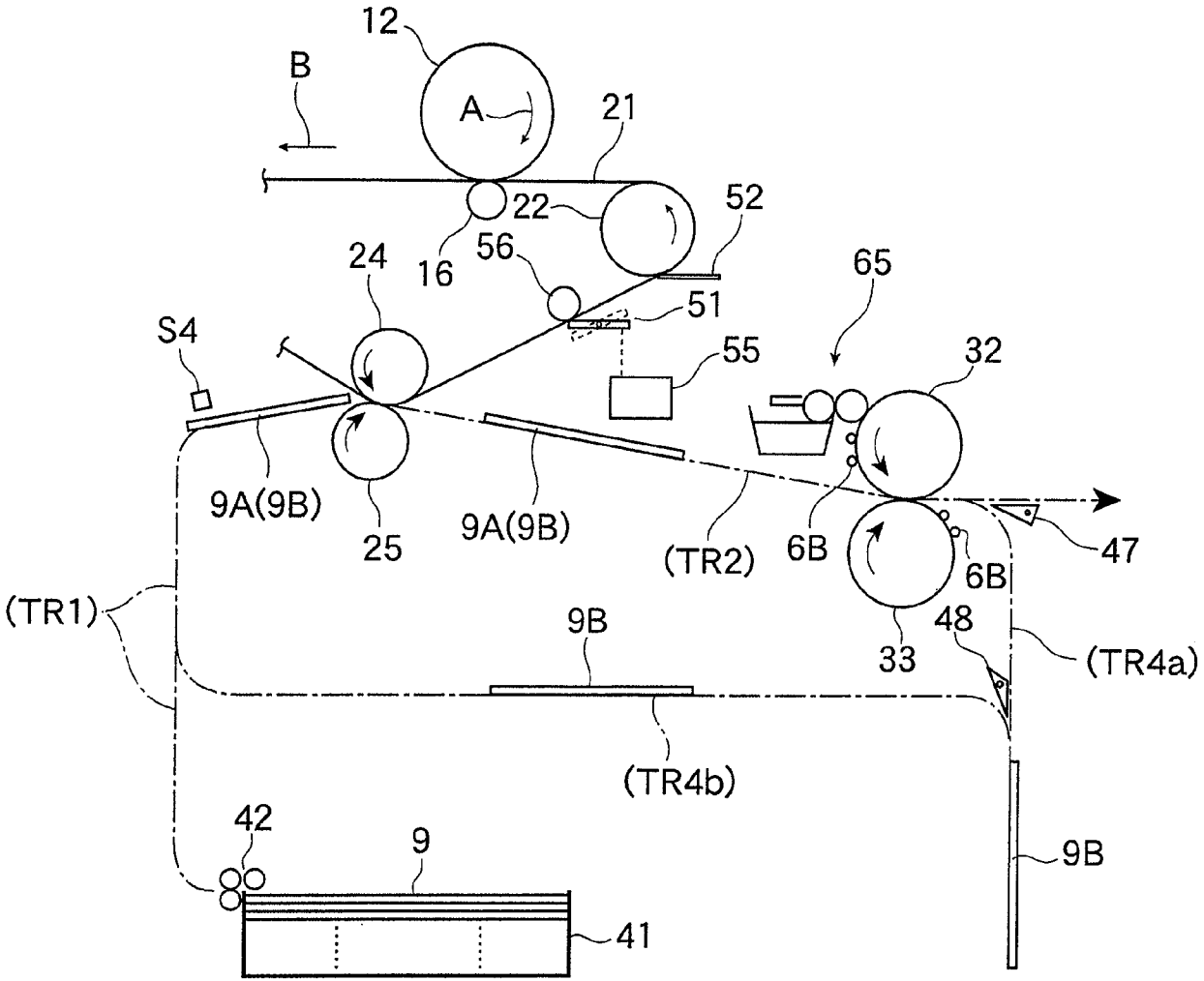
FIG. 11 is a diagram showing a state where the operation of supplying the release agent in the second embodiment (particularly, an operation of conveying a sheet, and the like) is performed.

As shown in FIGS. 10 and 11, under the control of the controlling device 8, first, the sheet feeding device 40 and the sheet conveying device 42 of the first sheet conveying path TR1 are operated so that one sheet 9A housed in the sheet feeding cassette 41 is taken out and then conveyed to the secondary transfer position through the first sheet conveying path TR1 (S30 shown in FIG. 10). At this time, the image forming device 10 and the secondary transferring device do not perform the formation of a toner image and the transferring process, and are operated so that the photosensitive drum 12, the intermediate transfer belt 21, and the like are simply kept to be rotated. Therefore, the sheet 9A which is conveyed and passed through the secondary transfer position is not subjected to the transfer of a toner image, and maintained to be in the so-called blank state. As the sheet 9A to be conveyed in this case, it is preferable to use a sheet having a size or feeding direction (posture) having a width (length) which is approximately equal to that of the width-direction effective region of the intermediate transfer belt 21.

Under the control of the controlling device 8, then, the belt conveying device 44 of the second sheet conveying path TR2, the fixing device 30, and the reversing and reconveying device 48 of the fourth sheet conveying path TR4 are operated so that the sheet 9A which has been conveyed to the secondary transfer position, and which is in the blank state is conveyed to the fixing device 30, and then reconveyed to the secondary transfer position through the fourth sheet conveying path TR4, in a state where the front and rear faces of the sheet are reversed (S31). In this case, the sheet 9A is passed through the fixing device 30. As described above, therefore, at least part of the release agent 6B which is applied from the release-agent applying device 65 to the surfaces of the heating roll 32 and the pressurizing rotary member 33 is moved and adheres to the front and rear faces of the sheet 9A when the sheet is passed through the contacting portion between them. Accordingly, the sheet 9A after passed through the fixing device 30 is configured as a sheet (9B) in a state where the release agent 6B adheres to the front and rear faces.

After passed through the fixing device 30, the sheet 9B is reconveyed to the secondary transfer position. When, during the reconvenying process, the sheet is detected by the sheet detection sensor S4 in the first sheet conveying path TR1, it is determined that the sheet 9B is immediately before the sheet reaches the secondary transfer position (S32), and the following operation is performed. Under the control of the controlling device 8, the contacting/separating device 55 is operated so that the first cleaning plate 51 of the second cleaning device 50 is swung in the direction of the arrow D about the support shaft 54, thereby forming a state where the contacting end portion of the first cleaning plate 51 is separated from the surface of the intermediate transfer belt 21 (S33). Also during this operation, the sheet 9B is conveyed so as to be passed through the secondary transfer position.

Figure 12:
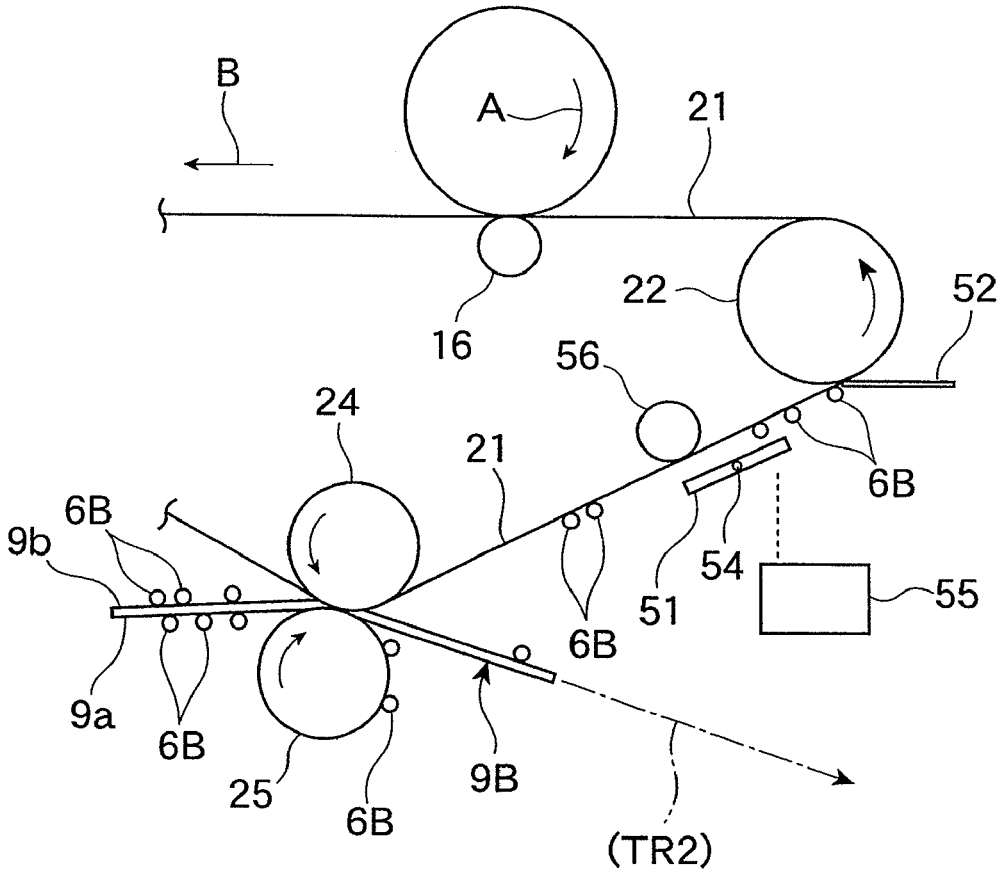
FIG. 12 is a diagram showing a state where the operation of supplying the release agent in the second embodiment is performed (particularly, a state where a first cleaning plate is separated)

As shown in FIG. 12, when the sheet 9B which has been passed through the fixing device 30, and to which the release agent 6B has adhered is passed through the secondary transfer position, accordingly, the release agent 6B adhering to the rear face (second face) 9*b* of the reversed sheet is moved and adheres to the surface of the intermediate transfer belt 21. In this case, as described above, the first cleaning plate 51 is kept to the state where it is separated from the surface of the intermediate transfer belt 21. Therefore, the release agent 6B which has been moved from the sheet 9B and adheres to the surface of the intermediate transfer belt 21 is not scraped off from the surface of the belt by the first cleaning plate 51, and hence the release agent is conveyed and supplied to the contacting portion of the second cleaning plate 52 with respect to the surface of the intermediate transfer belt 21. As a result, even when a metal plate is used as the second cleaning plate 52, the frictional resistance of the cleaning plate 52 to the intermediate transfer belt 21 is reduced by the existence of the release agent 6B. Therefore, the same effect as the first embodiment is obtained.

As shown in FIG. 10, the operation of supplying the release agent is performed only during a period when a predetermined time period elapses after the timing when it is proved that the count value of the number of sheets on which an image is formed reaches the predetermined number S (S34). After the predetermined time period elapses, under the control of the controlling device 8, the contacting/separating device 55 is again operated so that a state where the first cleaning plate 51 is in contact with the surface of the intermediate transfer belt 21 is formed (S35).

Third Embodiment

Figure 13:
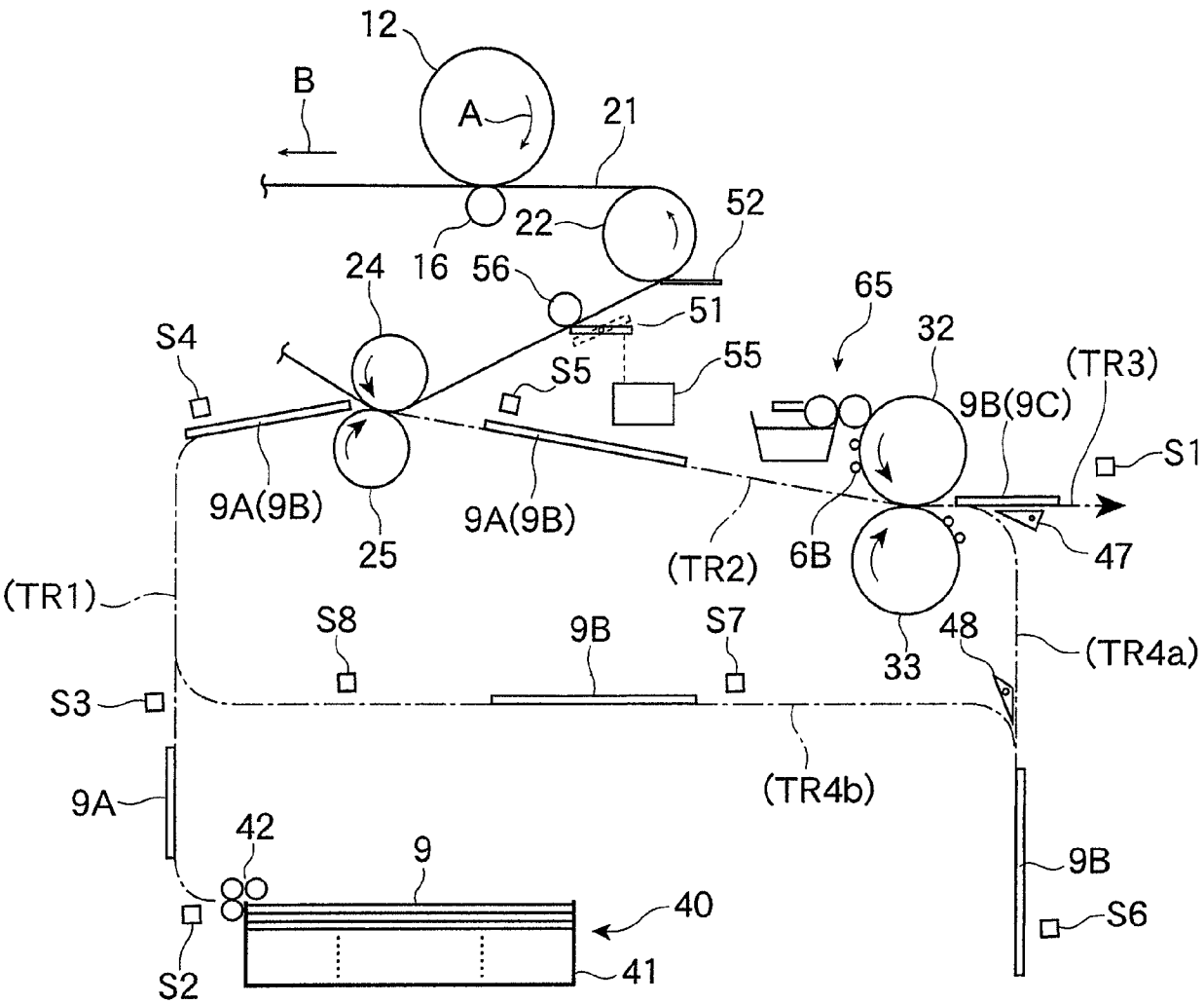
FIG. 13 is a diagram showing the configuration of detecting sheet jamming and a state of a sheet under conveyance in the third embodiment.

FIG. 13 shows main portions of an image forming apparatus 1C of a third embodiment of the invention.

The image forming apparatus 1C is configured in the same manner as the image forming apparatus 1B of the second embodiment except that a function of, after jamming of the sheet 9 in the sheet conveying paths (TR1 to TR4) is detected, discharging a sheet 9C which is not jammed, and which is under conveyance to the discharging and housing portion 49 (often referred to as, for example, "purge process") is added, and the configuration relating to the operation of supplying the release agent is changed.

The detection of jamming of the sheet 9 in the sheet conveying paths (TR1 to TR4) is set in the following manner. Plural sheet detection sensors (S1 to S8) are adequately placed in plural places of the sheet conveying paths, and the like, and the sheet detection sensors are connected to the controlling device 8 (see FIG. 4). When passage of the sheet 9 is not detected by one of the sheet detection sensors S1 to S8 within a predicted time period, the controlling device 8 determines that jamming occurred in a conveying path portion between the detection-failure sensor in which passage is not detected, and the sheet detection sensor which is placed at the nearest position on the front side of the detection-failure sensor in the sheet conveying direction. When the occurrence of sheet jamming is detected, the controlling device 8 compulsively stops all sheet conveying operations.

In this case, it is deemed that the sheet 9 existing in the conveying path portion in front of the position where the sheet detection sensor in which passage is not detected by within the predicted time period is disposed caused jamming. Furthermore, the detection is set so that, in the case where a sheet the passage of which is detected by one of the sheet detection sensors S1 to S8 within the predicted time period exists, the sheet is deemed as the sheet 9 which is under conveyance. The position where the sheet 9 under conveyance exists is substantially known from detection information obtained by the sheet detection sensors S1 to S8.

In the case where it is determined that the sheet 9 under conveyance exists, the jammed sheet 9 is removed away, and then the sheet conveying devices of the sheet conveying paths (TR1 to TR4) are operated to convey the sheet 9 under conveyance, whereby all sheets are finally discharged to the discharging portion 49. When the operation of discharging the sheet 9 under conveyance is performed, also the below-described operation of supplying the release agent is conducted.

Figure 14:
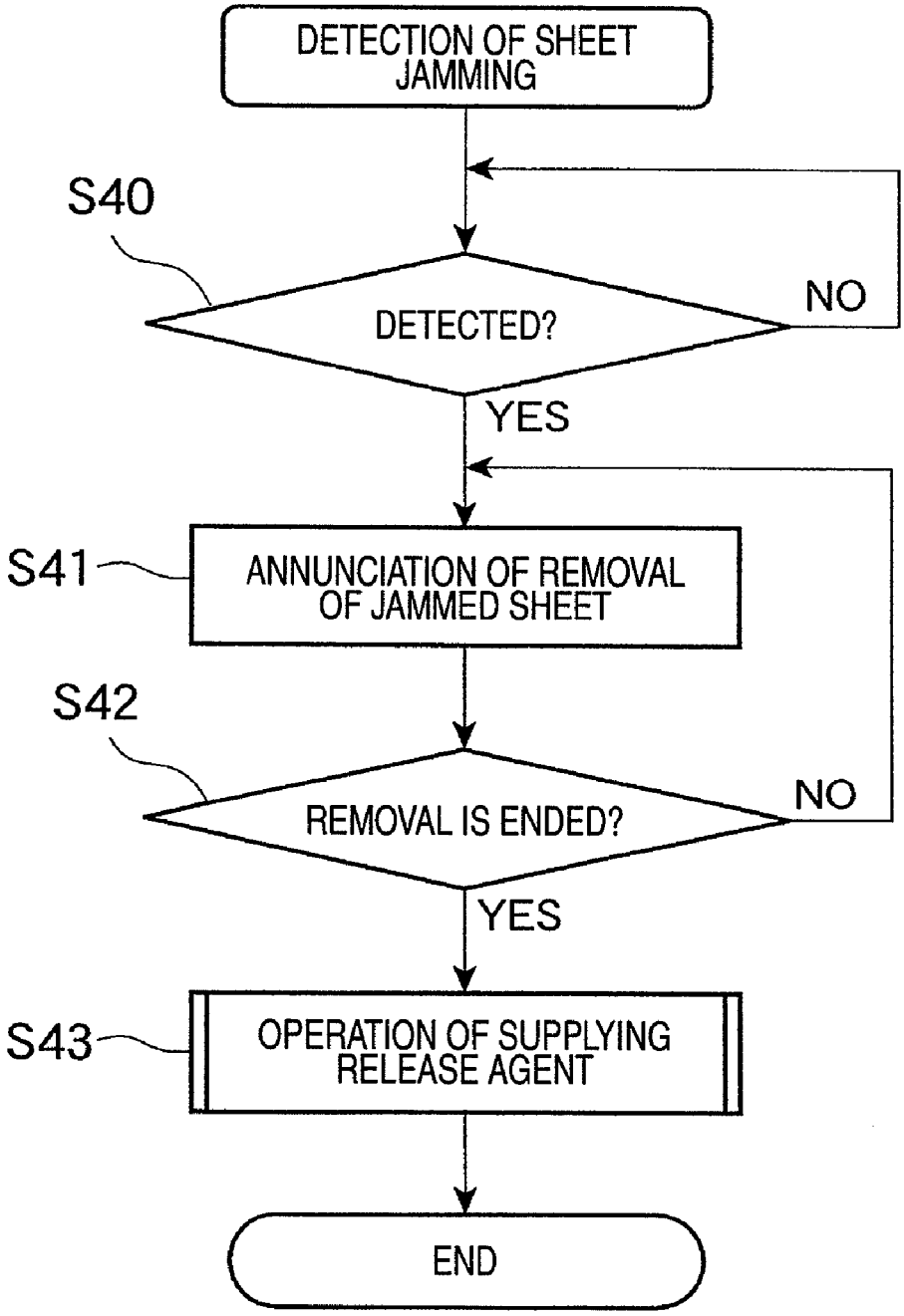
FIG. 14 is a flowchart showing an operation relating to a timing when an operation of supplying a release agent (an operation relating to detection of sheet jamming) in the third embodiment is performed.
Figure 15:
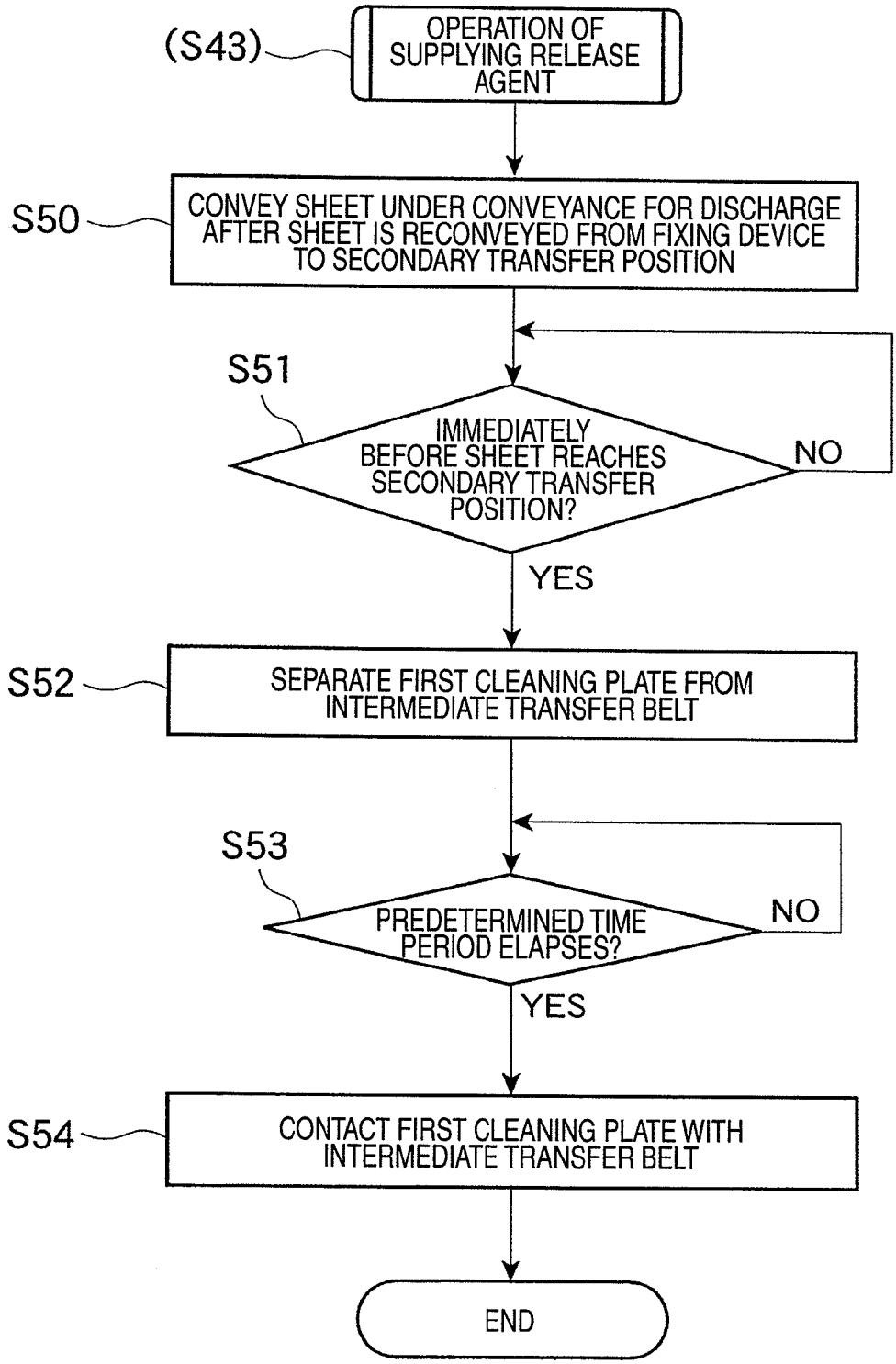
FIG. 15 is a flowchart showing the operation of supplying the release agent in the third embodiment.

The operation of supplying the release agent is set in the following manner. As shown in FIGS. 14 and 15, in the case where jamming of the sheet 9 occurs, after it is confirmed that removal of the jammed sheet 9 is ended, an operation of passing at least one sheet which is other than the jammed sheet, and which is under conveyance, through the fixing device 30, and reconveying the sheet to the secondary transfer position is performed under control of the controlling device 8. Also an operation of, after a timing immediately before the sheet 9 is reconveyed to and reaches the secondary transfer position, setting the first cleaning plate 51 of the second cleaning device 50 to a state where it is separated from the surface of the intermediate transfer belt 21 is performed.

Hereinafter, among operations of the image forming apparatus 1C, only those which are different from the operations of the image forming apparatus 1B of the second embodiment will be described.

When the image forming apparatus 1C performs the printing operation, the following detection of jamming of the sheet 9 is always conducted.

It is monitored whether one of the sheet detection sensors S1 to S8 which are adequately placed in the sheet conveying paths, and the like detects passage of the sheet 9 under conveyance within the predicted time period or not (s40 in FIG. 14). If detected, the controlling device 8 performs a display (annunciation) of "remove jammed sheet" on a display unit (not shown) of the image forming apparatus 1C, and continues the display until it is detected that a work of removing the sheet is ended (S41 and S42). The detection of the end of the work of removing the sheet is performed in the following manner. For example, an opening/closing detection sensor S10 for detecting opening/closing operations of a door through which the sheet conveying paths of the image forming apparatus 1C can be seen is disposed, and connected to the controlling device 8 (see FIG. 4). When the controlling device receives signals indicative of detection of opening/closing operations of the door from the opening/closing detection sensor S10, it is deemed that the removal work is ended.

When it is detected that the work of removing the jammed sheet 9 is ended, the following operation of supplying the release agent is performed (S43).

When the sheet 9 under conveyance exists, as shown in FIG. 15, the controlling device 8 controls the sheet conveying device 42 and the like of the sheet conveying paths TR1 to TR4 so that the sheet 9 under conveyance is conveyed to the fixing device 30, and then reconveyed to the secondary transfer position in the state where the front and rear faces are reversed, through the fourth sheet conveying path TR4 (S50).

At this time, the sheet 9 under conveyance which is to be conveyed is a sheet 9A which has not yet been passed through the fixing device 30 before the jamming occurs. In the case where there are such plural sheets 9A, all of the sheets 9A are set as objects of conveyance, or alternatively a part (including one) of the sheets may be set as objects of conveyance. In the case where a sheet 9B which has been passed at least one time through the fixing device 30, and to which the release agent 6B adheres exists, the sheet is not required to be set as an object of conveyance, and can be discharged to the discharging and housing portion 49 through the remaining sheet conveying paths. Alternatively, the sheet may be set as objects of conveyance. When the sheet 9A (9B) under conveyance is to be conveyed, in the same manner as the second embodiment, the image forming device 10 and the secondary transferring device do not perform the formation of a toner image and the transferring process, and are operated so that the photosensitive drum 12, the intermediate transfer belt 21, and the like are simply kept to be rotated. When the sheet 9A is passed through the fixing device 30, in the same manner as the second embodiment, the release agent 6B is moved and adheres to the front and rear faces of the sheet 9A through the heating roll 32 and the pressurizing rotary member 33 from the release-agent applying device 65 as described above.

With respect to the sheet 9B which is initially reconveyed to the secondary transfer position after it is passed through the fixing device 30 and the release agent 6B adheres to it, when the sheet is detected during reconveyance by the sheet detection sensor S4 in the first sheet conveying path TR1, it is determined that the sheet 9B is immediately before the sheet reaches the secondary transfer position (S51), and the following operation is performed. Under the control of the controlling device 8, the contacting/separating device 55 is operated so that the first cleaning plate 51 of the second cleaning device 50 is swung in the direction of the arrow D about the support shaft 54, thereby forming a state where the contacting end portion of the first cleaning plate 51 is separated from the surface of the intermediate transfer belt 21 (S52). Also during this operation, the sheet 9B is conveyed so as to be passed through the secondary transfer position.

As shown in FIG. 12, when the sheet 9B which has been passed through the fixing device 30, and to which the release agent 6B has adhered is passed through the secondary transfer position, accordingly, the release agent 6B adhering to the rear face (second face) 9*b* of the reversed sheet is moved and adheres to the surface of the intermediate transfer belt 21. In this case, as described above, the first cleaning plate 51 is kept to the state where it is separated from the surface of the intermediate transfer belt 21. Therefore, the release agent 6B which has been moved from the sheet 9B and adheres to the surface of the intermediate transfer belt 21 is not scraped off by the first cleaning plate 51, and hence the release agent is conveyed and supplied to the contacting portion of the second cleaning plate 52 with respect to the surface of the intermediate transfer belt 21. As a result, even when a metal plate is used as the second cleaning plate 52, the frictional resistance of the cleaning plate 52 to the intermediate transfer belt 21 is reduced by the existence of the release agent 6B. Therefore, the same effect as the second embodiment is obtained.

As sheets under conveyance, a sheet 9A which has not yet been passed through the fixing device 30, and a sheet 9B which has been passed at least one time through the fixing device 30, and to which the release agent 6B adheres may mixedly exist. In such a case, after the work of removing the jammed sheet is ended, the sheets are conveyed so as to be finally discharged to the discharging and housing portion 49 as described above. In the case where, when the conveyance is started, the sheet 9B initially reaches the secondary transfer position, the operation of separating the first cleaning plate 51 from the surface of the intermediate transfer belt 21 is started after the sheet 9B is detected by the sheet detection sensor S4.

As shown in FIG. 15, the operation of supplying the release agent is performed only during a period when a predetermined time period elapses after the timing when it is proved that the count value of the number of sheets on which an image is formed reaches the predetermined number S (S53). After the predetermined time period elapses, under the control of the controlling device 8, the contacting/separating device 55 is again operated so that a state where the first cleaning plate 51 is in contact with the surface of the intermediate transfer belt 21 is formed (S54).

Fourth Embodiment

Figure 16:
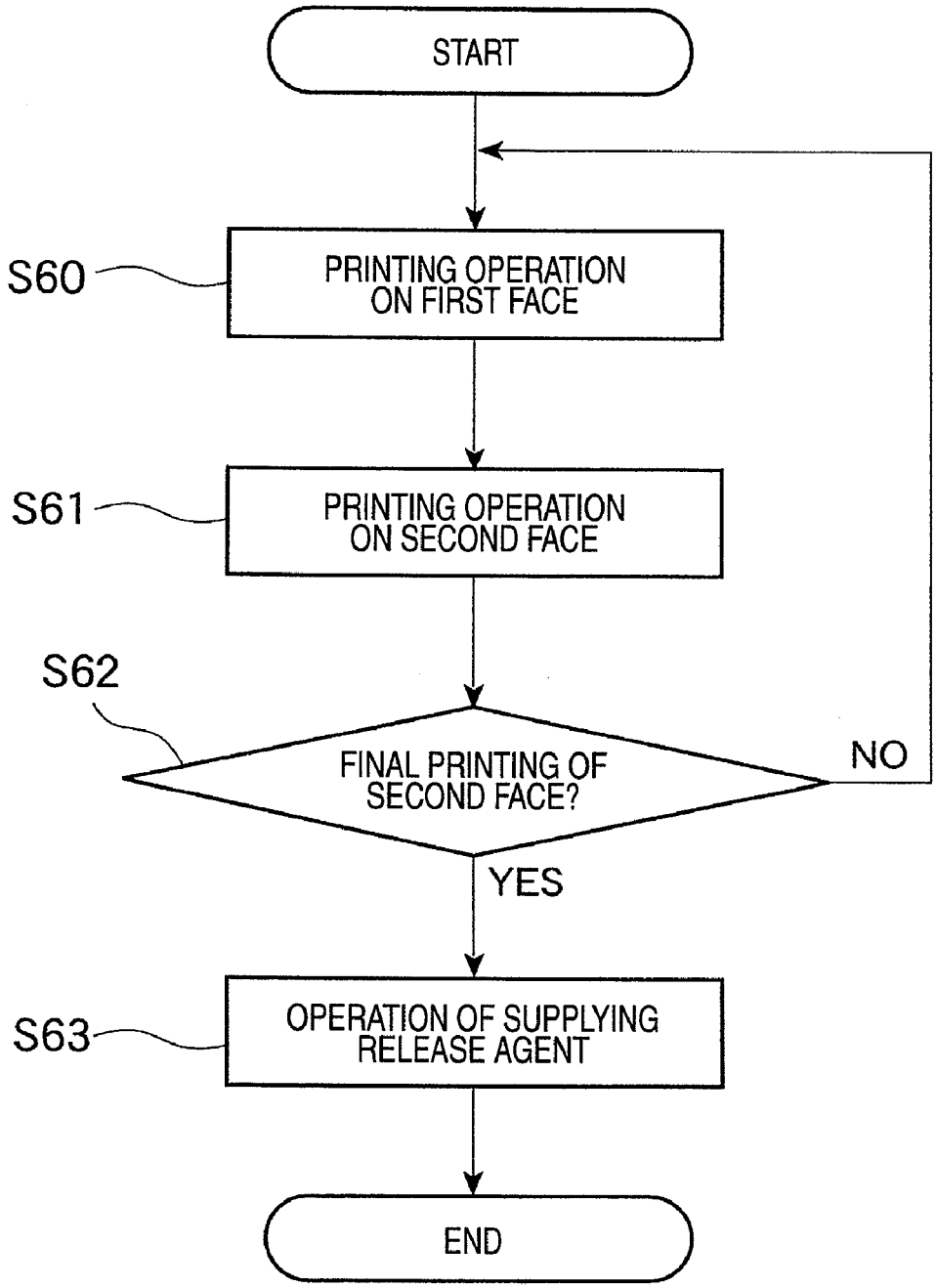
FIG. 16 is a flowchart showing an operation relating to a timing when an operation of supplying a release agent (an operation of double-face print) in the fourth embodiment is performed.

FIG. 16 shows main portions (a configuration relating to the operation of supplying the release agent) of an image forming apparatus 1D of a fourth embodiment of the invention.

The image forming apparatus 1D is configured in the same manner as the image forming apparatus 1B of the second embodiment except that the configuration relating to the operation of supplying the release agent is changed.

Figure 17:
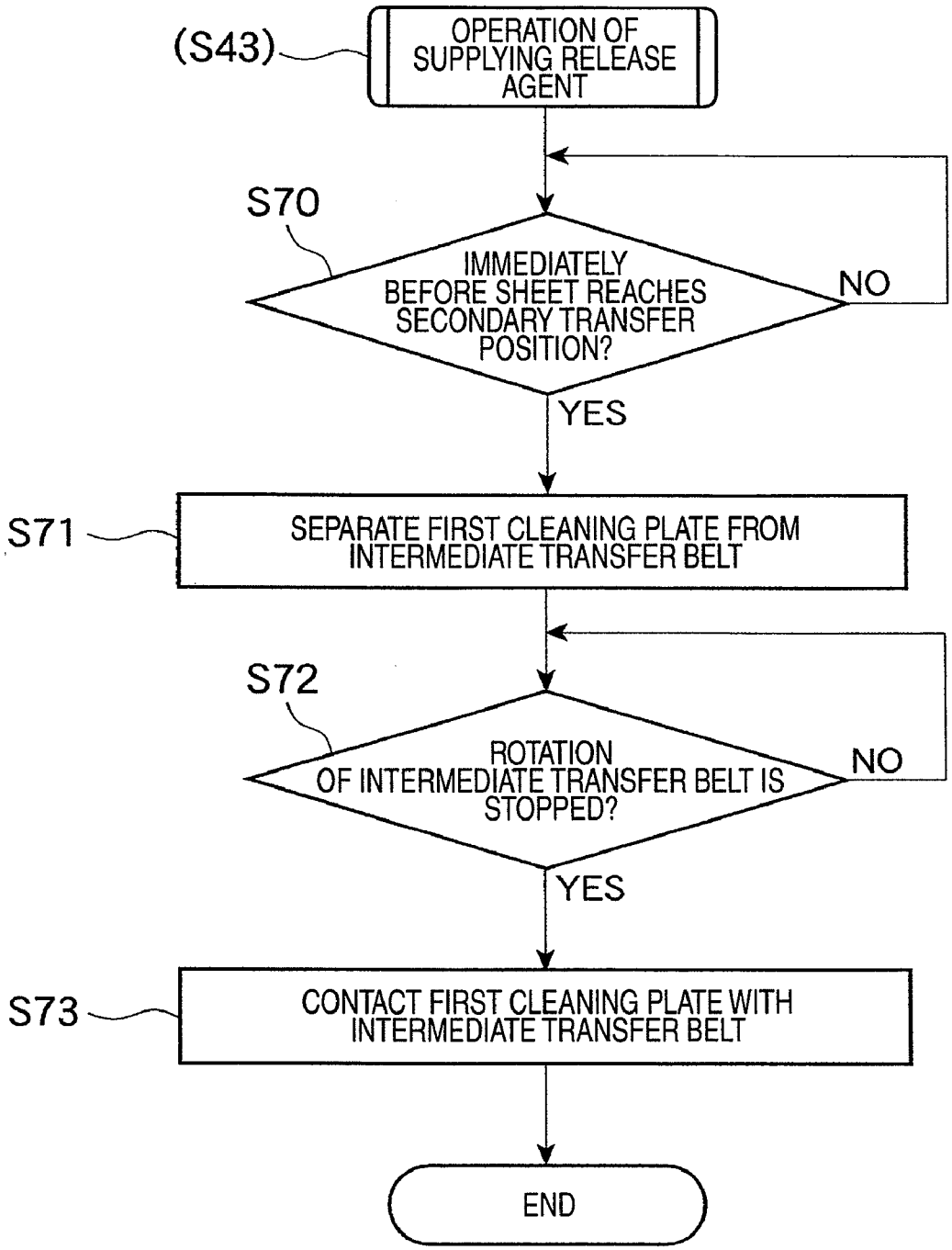
FIG. 17 is a flowchart showing the operation of supplying the release agent in the fourth embodiment.

The operation of supplying the release agent is set in the following manner. As shown in FIGS. 16 and 17, when the double-face image formation is to be performed by the image forming apparatus 1D, the operation of separating the first cleaning plate 51 of the second cleaning device 50 from the surface of the intermediate transfer belt 21 is performed only during a period from a timing immediately before a last sheet 9 in the requested double-face image formation is conveyed for transfer of a toner image to the rear face (second face) to reach the secondary transfer position, to a timing when rotation of the intermediate transfer belt 21 is stopped.

Hereinafter, among operations of the image forming apparatus 1D, only those which are different from the operations of the image forming apparatus 1B of the second embodiment will be described.

When the double-face printing operation is requested, as shown in FIG. 16, after the printing operation is performed on the first face of the sheet 9 (S60), the sheet 9 is passed through the fixing device 30, then reconveyed to the secondary transfer position through the fourth sheet conveying path TR4, and the printing operation (here, particularly, the operations of forming and transferring a toner image by the image forming device 10 and the intermediate transferring device 20) on the second face is performed (S61). When the printing operation on the second face is started, the controlling device 8 determines whether the operation is the final printing of the requested double-face printing operation or not (S62). If the operation is the final printing on the second face, the operation of supplying the release agent is performed (S63). By contrast, if the operation is not the final printing on the second face, the remaining double-face printing operation is continued to be performed.

In the operation of supplying the release agent, in the case where the sheet 9 corresponding to the final printing on the second face is reconveyed for transfer of a toner image to the second face to the secondary transfer position, when the sheet is detected by the sheet detection sensor S4 in the first sheet conveying path TR1, it is determined that the sheet 9 is immediately before the sheet reaches the secondary transfer position (S70), and the following operation is performed. Under the control of the controlling device 8, the contacting/separating device 55 is operated so that the first cleaning plate 51 of the second cleaning device 50 is swung in the direction of the arrow D about the support shaft 54, thereby forming a state where the contacting end portion of the first cleaning plate 51 is separated from the surface of the intermediate transfer belt 21 (S71). Also during this operation, the sheet 9B is conveyed so as to be passed through the secondary transfer position.

In the case where the double-face printing operation is performed, as described above, the release agent 6B adheres to the sheet 9 in which the printing operation on the first face is ended, as result of passage through the fixing device 30. When the sheet is reconveyed for the printing operation on the second face to the secondary transfer position and passed therethrough, therefore, at least part of the release agent 6B adhering to the sheet 9 is moved and adheres to the surface of the intermediate transfer belt 21. When the sheet 9 reconveyed for the final printing on the second face to the secondary transfer position is passed through the secondary transfer position, the last toner image for the second face is secondary-transferred from the intermediate transfer belt 21 to the sheet 9, and on the other hand at least part of the release agent 6B which adhered to the sheet 9 during passage through the fixing device 30 adheres to the surface of the intermediate transfer belt 21.

When the sheet 9 for the final printing on the second face is reconveyed to and passed through the secondary transfer position, as described above, the state where the first cleaning plate 51 is separated from the surface of the intermediate transfer belt 21 is kept. Therefore, the release agent 6B which has been moved from the sheet 9 and adhered to the surface of the intermediate transfer belt 21 is not scraped off by the first cleaning plate 51, and hence conveyed and supplied to the contacting portion between the second cleaning plate 52 and the surface of the intermediate transfer belt 21. As a result, even when a metal plate is used as the second cleaning plate 52, the frictional resistance of the cleaning plate 52 to the intermediate transfer belt 21 is reduced by the existence of the release agent 6B. Therefore, the same effect as the second embodiment is obtained.

As shown in FIG. 17, the operation of supplying the release agent is performed until a timing when the rotation of the intermediate transfer belt 21 is stopped after the final printing operation on the second face is ended and the sheet 9 is discharged to the discharging and housing portion 49 (S72). After the timing when the rotation of the intermediate transfer belt 21 is stopped, under the control of the controlling device 8, the contacting/separating device 55 is again operated to set the state where the first cleaning plate 51 is in contact with the surface of the intermediate transfer belt 21 (S73).

Other Embodiments

In the first and second embodiments, the case where the operation of supplying the release agent is performed each time when the cumulative number of sheets on which image formation has been performed reaches the predetermined number S has been described. The timing when the operation is performed may be set to another timing. For example, a timing such as that when the image forming apparatus is powered on, or that before the image forming operation is started may be used. Alternatively, an inputting unit for instructing the operation of supplying the release agent may be disposed, and a timing when the unit is operated may be used.

In the second to fourth embodiments, the case where the operation of supplying the release agent (the operation of separating the first cleaning plate 51) is started at a timing immediately before the sheet is reconveyed to and reaches the secondary transfer position has been described. The start timing may be set to another timing. For example, a timing after the sheet is reconveyed to and reaches the secondary transfer position may be employed. In this case, the detection of the timing when the sheet reaches can be realized by, for example, a detection operation of a sheet detection sensor S5 which is placed immediately behind the passage of the secondary transfer position.

The configurations of the image forming apparatuses 1A to 1D of the embodiments are not particularly restricted as far as the intermediate transfer system is employed. For example, a configuration may be employed in which one photosensitive drum is used, and an image forming device in which plural developing devices storing toners of different colors are placed for the photosensitive drum so as to approach and separate from a developing position are employed, thereby forming a toner image of plural colors. In place of the intermediate transfer belt 21, a drum-type intermediate transfer member may be used. Furthermore, the release-agent applying devices 60, 65 may have another configuration as far as a release agent can be applied in a state of contacted to the surfaces of the intermediate transfer belt 21, the heating roll 32, etc. For example, a configuration in which a rotary member such as a roll impregnated with a release agent (such as silicone oil) is in contact with the surfaces of the intermediate transfer belt 21 and the like to apply the release agent to the surfaces may employed.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an image forming device that forms an image developed by a toner, and that transfers the image;

an intermediate transfer member that is rotated while holding the toner image transferred from the image forming device;

a secondary transferring device that secondary-transfers the toner image held by the intermediate transfer member, to a sheet;

a fixing device that fixes the toner image transferred from the secondary transferring device, to a sheet;

a release-agent applying device that applies a release agent to a fixing surface of the fixing device;

a sheet conveying device that conveys the sheet to the secondary transfer device;

a reversing and reconveying device that reconveys the sheet which has been passed through the fixing device, to a secondary transfer position between the intermediate transfer member and the secondary transferring device, in a state where front and rear faces of the sheet are reversed;

a first cleaning member that cleans the surface of the intermediate transfer member which has been passed through the secondary transferring device, in a state where the first cleaning member is in contact with a surface of the intermediate transfer member;

a second cleaning member that cleans the surface of the intermediate transfer member downstream of the first cleaning member in a rotation direction, in a state where the second cleaning member is in contact with a surface of the intermediate transfer member;

a contacting/separating device that displaces the first cleaning member to a state where the first cleaning member is in contact with the surface of the intermediate transfer member, and a state where the first cleaning member is separated from the surface; and a controlling unit that controls the sheet conveying device and the reversing and reconveying device so that at least one sheet is passed through the fixing device and then reconveyed to the secondary transfer position, and that controls the contacting/separating device so that, after a timing immediately before the sheet is reconveyed to and reaches the secondary transfer position, or after the sheet is reconveyed to and reaches the secondary transfer position, the first cleaning member is displaced to the state where the first cleaning member is separated from the surface of the intermediate transfer member.

2. The image forming apparatus according to claim 1, wherein the controlling unit that, at a predetermined timing, controls the sheet conveying device and the reversing and reconveying device so that, after a sheet in a state where a toner image is not transferred from the image forming device is conveyed to the secondary transfer position, the sheet is passed through the fixing device and then reconveyed to the secondary transfer position, and that controls the contacting/separating device so that, after a timing immediately before the sheet is reconveyed to and reaches the secondary transfer position, or after the sheet is reconveyed to and reaches the secondary transfer position, the first cleaning member is displaced to the state where the first cleaning member is separated from the surface of the intermediate transfer member.

3. The image forming apparatus according to claim 2, further comprising a sheet number counting unit that measures a number of sheets on which an image is formed, and, wherein each time when the number measured by the sheet number counting unit reaches a predetermined value, the controlling unit performs the control on the sheet conveying device and the reversing and reconveying device, and the control on the contacting/separating device.

4. The image forming apparatus according to claim 1, wherein the controlling unit which, when jamming of the sheet occurs, controls the sheet conveying device and the reversing and reconveying device so that at least one sheet that is other than the jammed sheet and under conveyance is passed through the fixing device, and then reconveyed to the secondary transfer position, and which controls the contacting/separating device so that, after a timing immediately before the sheet is reconveyed to and reaches the secondary transfer position, or after the sheet is reconveyed to and reaches the secondary transfer position, the first cleaning member is displaced to the state where the first cleaning member is separated from the surface of the intermediate transfer member.

5. The image forming apparatus according to claim 1, wherein the controlling unit which, when images are to be formed on the front and rear faces of the sheet, controls the contacting/separating device so that, only during a period from a timing immediately before a last sheet in the double-face image formation is conveyed for transfer of a toner image to the rear face to reach the secondary transfer position, or after the sheet is reconveyed to and reaches the secondary transfer position, to a timing when rotation of the intermediate transfer member is stopped, the first cleaning member is displaced to the state where the first cleaning member is separated from the surface of the intermediate transfer member.

* * * * *